US005616111A

United States Patent [19]

Randolph

[11] Patent Number: 5,616,111

[45] **Date of Patent: *Apr. 1, 1997**

[54] EXOSKELETAL EXERCISE SYSTEM

[76] Inventor: Lucian Randolph, 11456 Peachstone La., Orlando, Fla. 32675

[ * ] Notice: The term of this patent shall not extend beyond the expiration date of Pat. No. 5,486,150.

[21] Appl. No.: 383,476

[22] Filed: Feb. 1, 1995

Related U.S. Application Data

[63] Continuation-in-part of Ser. No. 56,845, Apr. 30, 1993, Pat. No. 5,486,150.

[51] Int. Cl.[6] ..... A63B 21/02; A63B 23/035

[52] U.S. Cl. ..... 482/133; 482/123; 482/130; 482/137

[58] Field of Search ..... 482/100, 101, 482/112, 121, 123, 124, 126, 129, 130, 133–139, 908, 142

[56] References Cited

U.S. PATENT DOCUMENTS

| | | | |
|---|---|---|---|
| 4,235,437 | 11/1980 | Ruis et al. | 482/137 |
| 4,772,015 | 9/1988 | Carlson et al. | 482/908 |
| 4,861,022 | 8/1989 | Boatcallie | 482/126 |
| 5,042,799 | 8/1991 | Stanley | 482/123 |
| 5,215,511 | 6/1993 | Cheng | 482/133 |
| 5,277,684 | 1/1994 | Harris | 482/137 |

FOREIGN PATENT DOCUMENTS

| | | | |
|---|---|---|---|
| 2127309 | 4/1984 | United Kingdom | 482/137 |
| 2162075 | 1/1986 | United Kingdom | 482/137 |
| 2223686 | 4/1990 | United Kingdom | 482/137 |

*Primary Examiner*—Richard J. Apley
*Assistant Examiner*—Jeanne M. Clark
*Attorney, Agent, or Firm*—Allen, Dyer, Doppelt, Milbrath & Gilchrist, P.A.

[57] ABSTRACT

An exercise frame includes an upstanding back rest and an intersecting seat, with pairs of exercise arm and leg assemblies supported along corresponding sides of the back rest. Each arm and leg assembly is segmented and linked together so as to limit and restrict movement of selected muscle groups within selected fixed planes defined to include a straight line passing through the corresponding proximal and distal ends while achieving loading of primary and secondary joint combinations.

17 Claims, 22 Drawing Sheets

HIP / SHOULDER JOINT

KNEE / ELBOW JOINT

EXOSKELETAL EXERCISE SYSTEM

CROSS-REFERENCE TO RELATED APPLICATION

This application is a continuation-in-part of application entitled "Exercise System, Apparatus and Method," Ser. No. 08/056,845 filed Apr. 30, 1993, now U.S. Pat. No. 5,486,150.

BACKGROUND

The present invention relates to exercise equipment and methods.

In general, exercise can be organized into two principal categories, cardiovascular and musculoskeletal. Cardiovascular exercises, such as aerobics, are quite popular. However, it is now known that cardiovascular training alone is not sufficient to obtain balanced fitness, and there is growing evidence identifying a clear need to provide for muscular and joint strength in addition to cardiovascular health.

Muscular development falls into four general types. One type is isometric contraction, which results in an increase of muscle tension while the muscle length remains constant. Typical examples of isometric muscular activity includes the flexing of the arm or pushing the hands together while the arm or hands are not moved through a range of motion. While the tension increases in the muscle, the muscle does not move.

The second type of muscle development is known as pleiometric contraction, which occurs when both the muscle tension and length increases. This type of contraction occurs in exercises such as walking down stairs or landing from a jump.

A third type of muscle activity is known as isotonic contraction, in which the muscle tension remains constant and the muscle length decreases; such muscle activity occurs in the legs during walking or running.

A fourth type of muscle activity is known as isokinetic contraction, and occurs when the muscle tension increases and the muscle length decreases. Conventional weight lifting is an example of this type of activity.

It is generally known that the best way to develop the shape, size and definition of muscles is to apply a resistance and then move the muscle through its entire range of motion from a full stretch to a full contraction and back to a full stretch (or vice versa). It is also known that to improve the strength of the bones and joints, it is necessary to move the joints through its correct plane of movement; movement through an incorrect plane may actually weaken or injure a joint, or fracture a bone.

In addition to so called "free weights" (i.e., barbells and the like) there have been developed a number of exercise machines which assist an individual in achieving isokinetic muscle exercise. These prior art machines are based on a variety of lever arm and other mechanical techniques. Some of these prior art systems have been developed to provide multiple purpose exercises for a variety of different muscles. Examples of such equipment are disclosed in the following United States patents: U.S. Pat. No. 4,951,942 to Walden; U.S. Pat. No. 4,919,419 to Houston; U.S. Pat. No. 4,907,798 to Burchatz; U.S. Pat. No. 4,826,157 to Fitzpatrick; U.S. Pat. No. 4,691,918 to Rockwell; U.S. Pat. No. 4,638,995 to Wilson; U.S. Pat. No. 4,627,614 to diAngeli; U.S. Pat. No. 4,618,144 to Gibson; U.S. Pat. No. 4,582,320 to Shaw; U.S. Pat. No. 4,576,377 to Wolff; U.S. Pat. No. 4,521,013 to Dofel, and U.S. Pat. No. 4,072,309 to Wilson. There is also disclosed in U.S. Pat. No. 4,623,267 an elastomeric bearing system for use in multiple purpose exercise apparatus, particularly of the type disclosed in U.S. Pat. No. 4,072,309 to Wilson, which is sold under the SOLOFLEX trademark. Recently, Nordictrack of Chaska, Minn. introduced an exercise system under the trademark NORDICFLEX GOLD, which system uses a straight rail and a lever arm to direct an exercise along a restricted plane.

The manner of operation of a typical lever-type prior art multiple purpose exercise system is illustrated in FIGS. 1 and 2. In one exercise known as the "bench press" shown in FIG. 1, the person exercising (designated by the letters "EP") rests upon a horizontal seat and maneuvers a lever L1 through an arc A1. With the lever under tension (for example, by the use of elastic bands as disclosed by Wilson in the aforementioned U.S. Pat. No. 4,072,309), isokinetic muscle contraction is achieved. However, because the arc A1 is displaced across the body of the exercising person EP, then different portions of the same muscle group are being utilized during the same exercise. Similarly, in using the equipment of FIG. 1 in an overhead exercise (as shown in FIG. 2), the exercising person, while operating the lever L2 under tension, is required to extend the lever L2 through an arc A2, thus also displacing the direction of exercise laterally and thereby using different muscle groups.

In U.S. Pat. No. 4,817,943, Pipasik discloses a total shoulder exercise and muscle development machine in which each forearm is placed against an arm abutment member, and then the forearms are rotated outwardly while the hands are also used to develop the shoulder by extension of a hand grip mechanism along a straight line into a spring biased cylinder.

SUMMARY OF THE INVENTION

Exercise is an activity that we do with our bodies. It causes a specific physiological response. Exercise is therefore a physical cause and the effect is seen in our body's response. The present invention provides cross-training for multiple non-impact exercise stimuli which can induce exercise responses for cardiovascular capacity (aerobic training), musculosketal strength (weight training), musculoskeletal flexibility (stretching), and endurance capacity (triathlon, mountain climbing, by way of example). The present invention comprises a cross-training apparatus of robotic arms and legs which apply mechanically produced forces (loads) to the body, during specific mechanically controlled vectors (movements). A combination of these adjustable force vectors applied to various points of the body during predetermined sets of controlled movements yields the desired exercise response. The robotic arms and legs control the movement and apply the load, while the center of gravity and body remains stationary. The user is responsible only for generating the force and maintaining the pace of the exercise. This substantially eliminates injury from an incorrect movement during an exercise performance. Both safe and effective, the present invention satisfies a need sought for cross-training exercise machines.

Among the purposes of the present invention is to provide a system, apparatus and related methods which permit the exercising of a selected muscle group of an individual along a straight line or muscle group planes containing the straight line which lies in a plane containing the muscle group and the proximal and distal extremities of the limb of the individual which is being exercised. In a preferred embodiment, this is achieved by providing an exercise frame and an arm assembly having a proximal end coupled to the frame and with the arm assembly also having a distal end. Means are provided for limiting movement of the distal end of the arm along a straight line which passes through both the proximal and distal ends or for limiting movement within defined planes for specific muscle groups, with means also provided for applying an exercise resistance to movement of the arm assembly and leg along the straight line or within the defined planes. The exercise resistance may be applied to either a movement of the distal end away from or toward the proximal end and for either primary or secondary joints or both. Means are also provided for changing the direction of the straight line from the proximal end.

In one form, the exercise arm and leg assemblies comprise first and second segments, with one end of the first segment comprising the proximal end and one end of the second segment comprising the distal end, with the first and second segments being coupled together at a pivot or equivalent mechanical means at a point intermediate between the proximal and distal ends. The straight line limiting means comprises, in one example, a positive linkage between the first and second segments in order to force simultaneous movement of the intermediate point as the distal end is moved along the straight line. In one specific arrangement, the positive linking means comprises a first sprocket rotatably supported by the first segment and a second sprocket fixed to the second segment at the pivot with a positive linkage belt engaging the first and second sprockets for rotation together. Suitably, the first sprocket has a diameter which is twice that of the second sprocket in order to achieve the desired straight line movement.

In the preferred arrangement, the first and second segments lie in a plane and means are provided for changing the angular relationship of the plane with respect to the frame. Such means in one form includes a bracket rotatably attached between the frame and the proximal end of the assembly. A rod or equivalent is coupled between the frame and the bracket, and provides means to change the direction of the straight line relative to the frame.

Also in the preferred embodiment, the system of the present invention has the capability to exercise different muscle groups and for limiting a single exercise to a single plane for a selected muscle. In particular, the system comprises an exercise frame including an upstanding back rest and a seat extending generally lateral from the back rest. A pair of exercise arm assemblies and leg assemblies are supported along respective sides of the back rest and have a proximal end adjacent the back rest and a distal end extending away from the proximal end with a hand grip and foot rest, respectively, at the distal ends. The pair of exercise leg assemblies are each supported along one side of the seat and having the proximal end adjacent the seat-back rest intersection and the distal end for engaging the leg or foot of the individual undertaking the exercise. Each of the arm and leg assemblies include means for restricting movement of the distal end to a straight line passing through both the distal and proximal ends, and which straight line lies in a plane which passes through the muscle, or contain the muscle group being exercised. Means are also provided for applying an exercise resistance to movement of the exercise assembly along the straight line, and for changing the angular relationship of each assembly with respect to the back rest, as well as the angular relationship between the seat and each leg assembly.

In use, the exercise system restricts movement of the distal end of the arm assembly along a line lying in a first plane (an exercise plane) passing through the selected muscle being exercised as well as the proximal and distal ends of the respective arm or leg assembly, while applying a resistance to the movement of the distal end across that first plane. The arm or leg assembly is then rotated to another position and thereafter movement of the distal end is restricted along a straight line lying in a second exercise plane position which also passes through the selected muscle as well as the proximal and distal ends of the respective arm or leg assembly. This procedure may be continued for several different planes through the same muscle. In this way, the system and apparatus of the present invention permits a person exercising to achieve a linear resistance which is restricted along a specific line or plane which passes through the particular muscle group being exercised, thus permitting the muscle being exercised to be carefully controlled. Further, the exercise system and apparatus permits the same muscle group to be exercised along different planes passing through that same muscle group, thereby achieving a more specific strengthening of that muscle group, as desired.

Other details and features of this invention will be understood from a review of the detailed description and drawings, discussed below.

THE DRAWINGS

FIGS. 1 and 2 are side views illustrating one prior art exercise system and the method of exercising using the system;

FIGS. 3*a* and 4*a*, are perspective and side views, respectively, illustrating the major components of an exercise system and apparatus according to the present invention;

FIGS. 3*b* and 4*b* are perspective and side views respectively, illustrating the major components of the exercise system and apparatus according to a preferred embodiment of the present invention;

Figure 17:
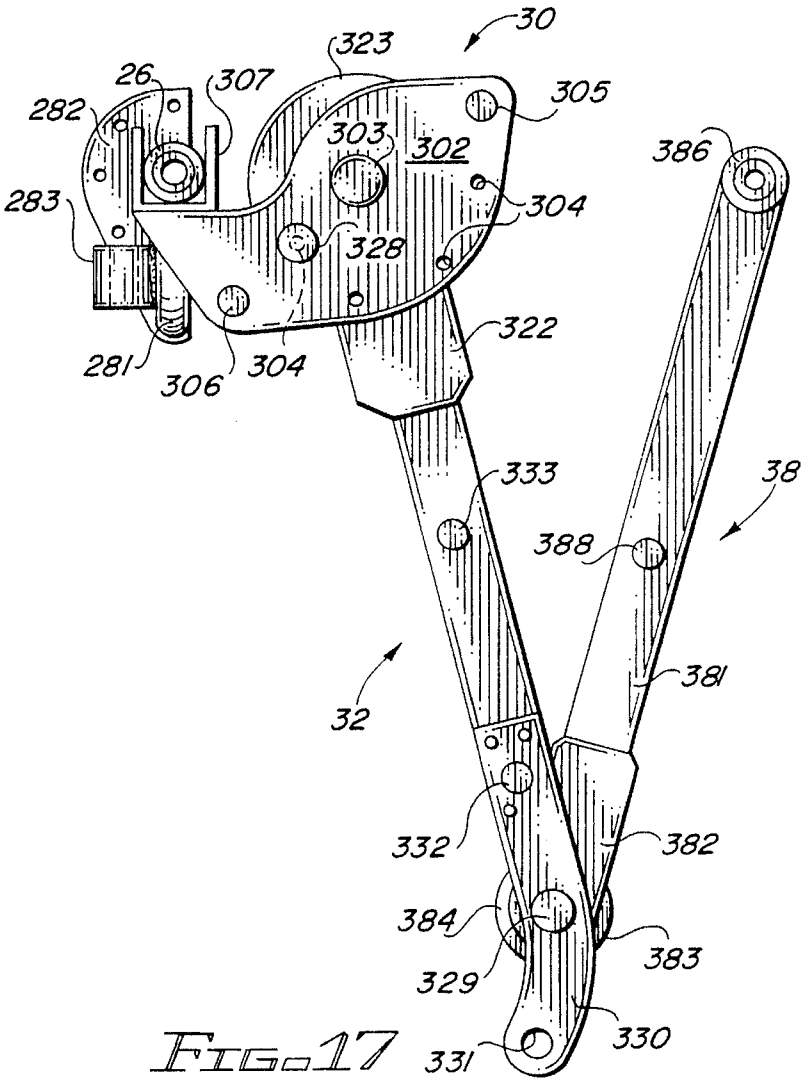
Figure 14A:
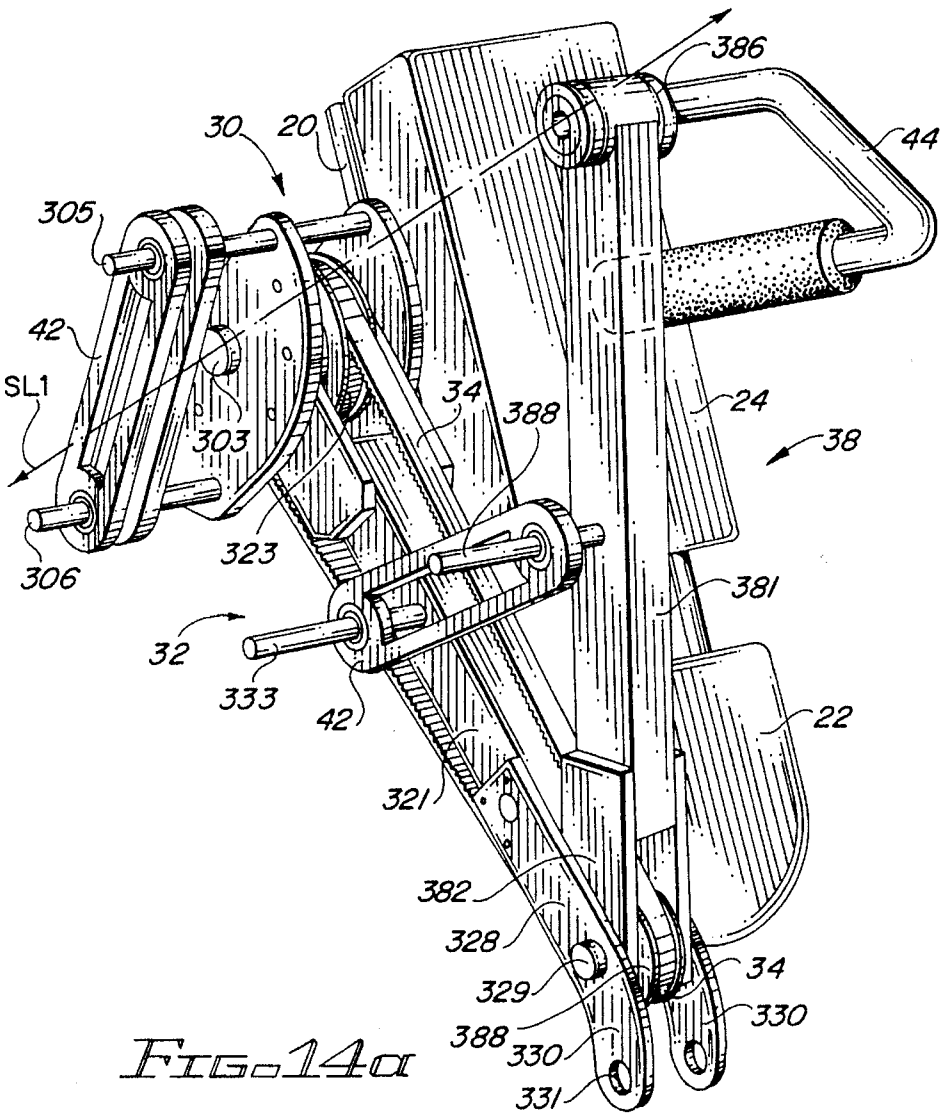
Figure 14B:
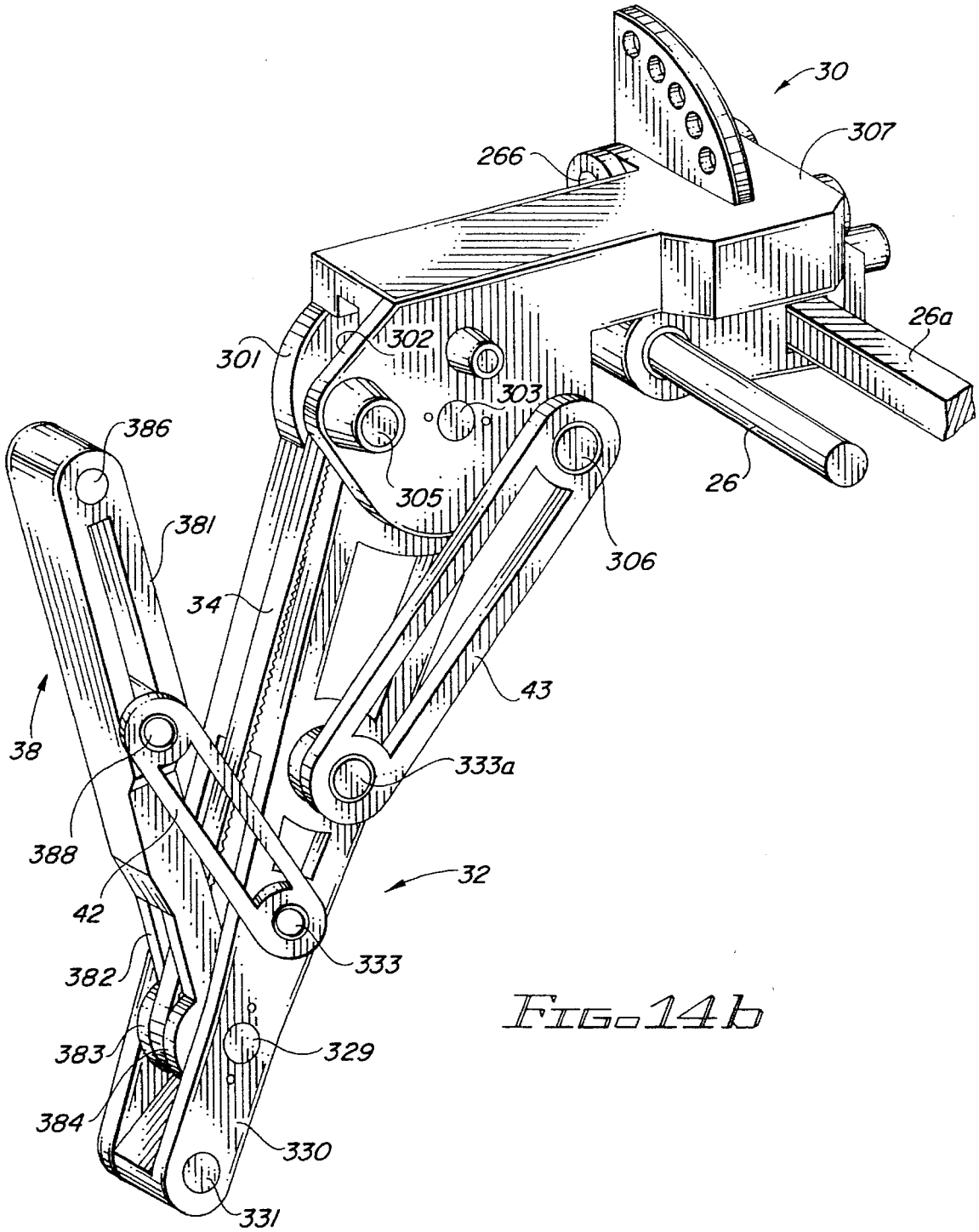
Figure 23:
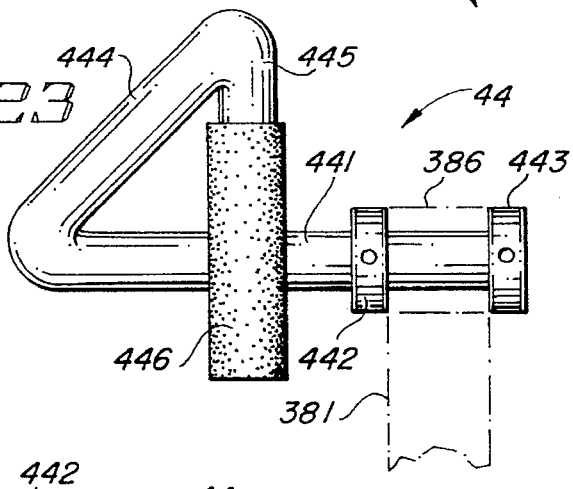
Figure 22:
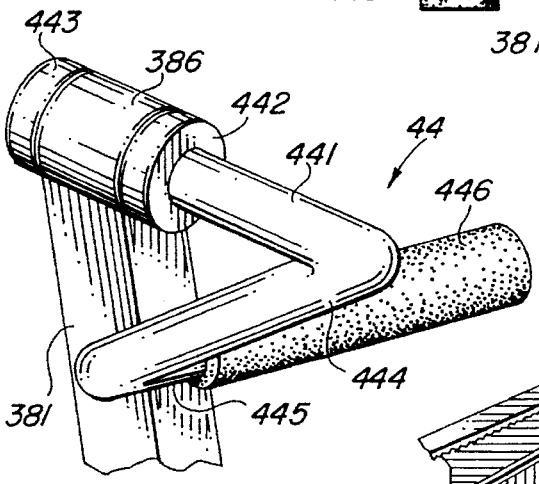
Figure 18:
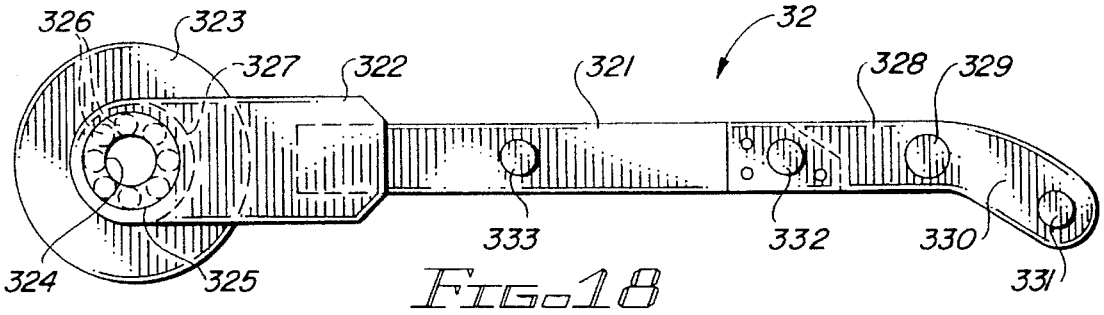
Figure 19:
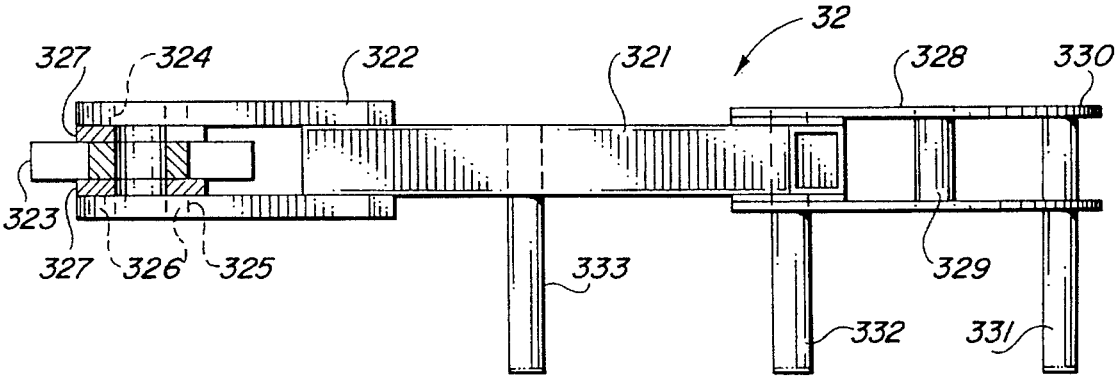
Figure 20:
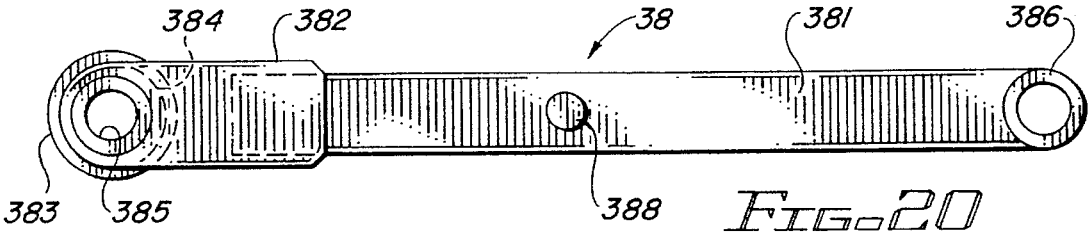
Figure 21:
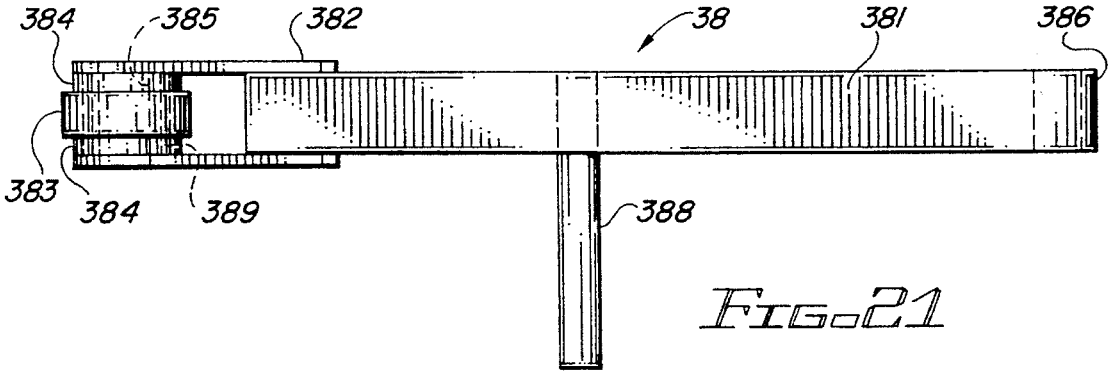
Figure 26:
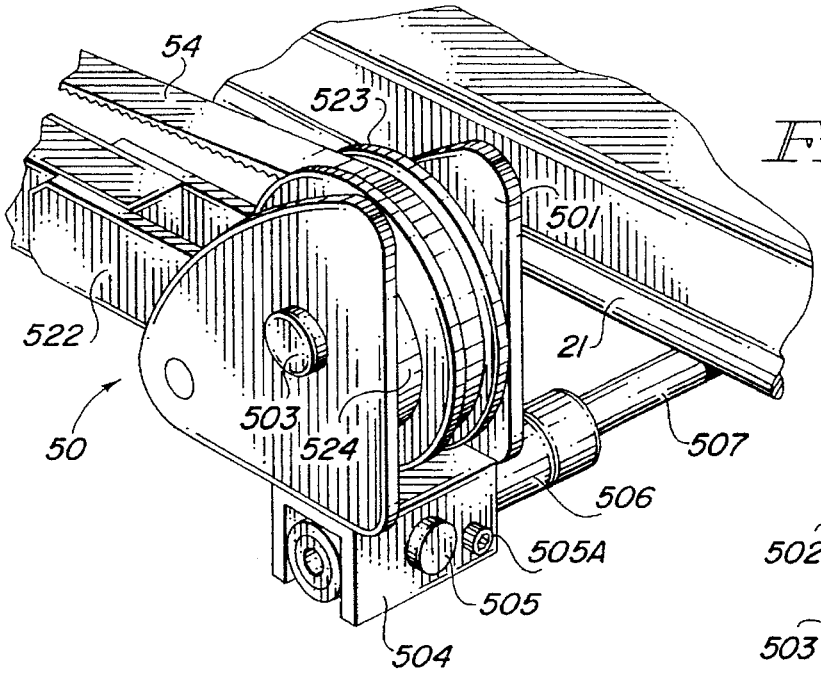
Figure 25:
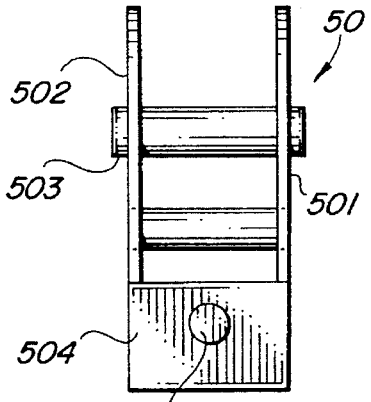
Figure 24:
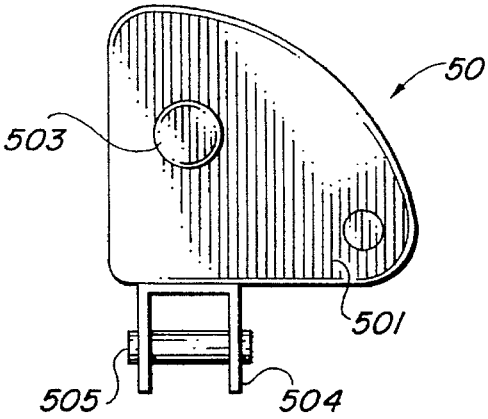
Figure 27:
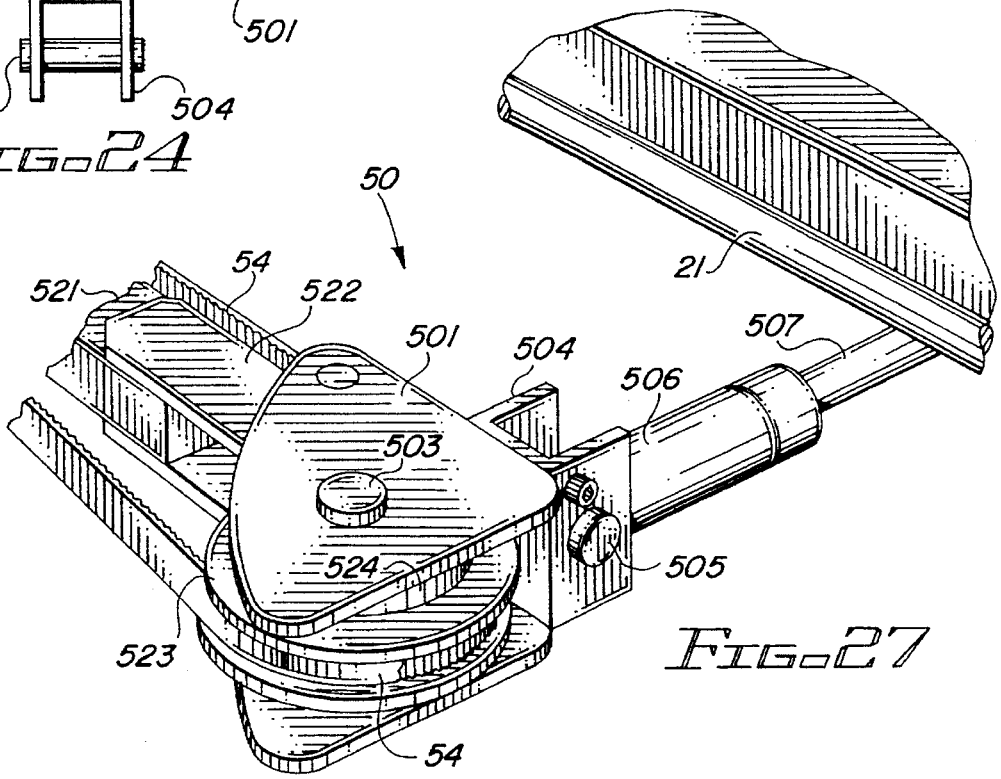
Figure 28A:
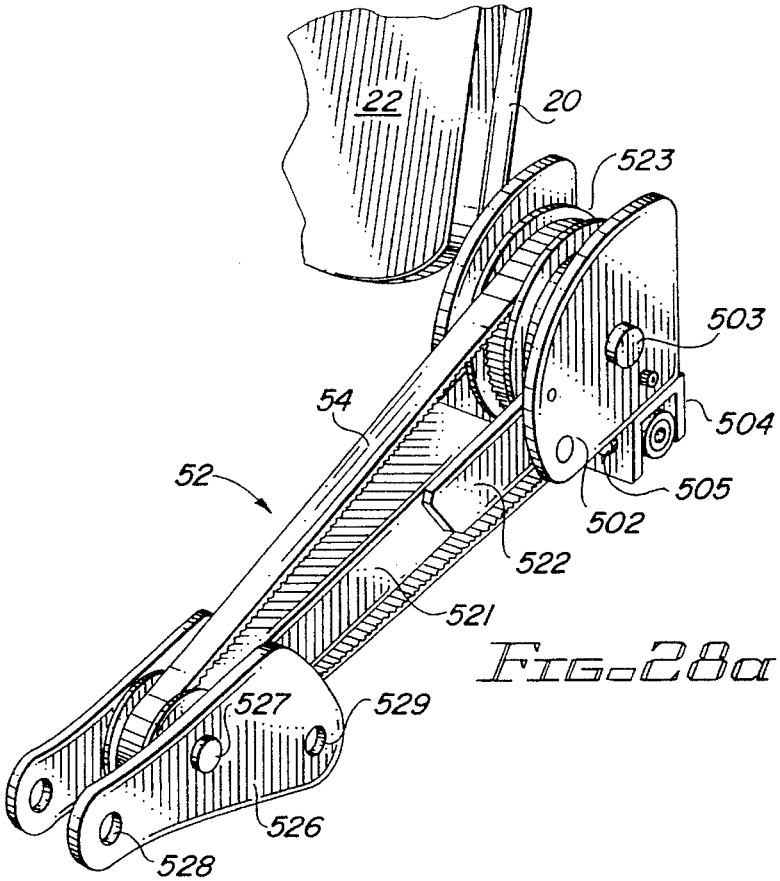
Figure 29:
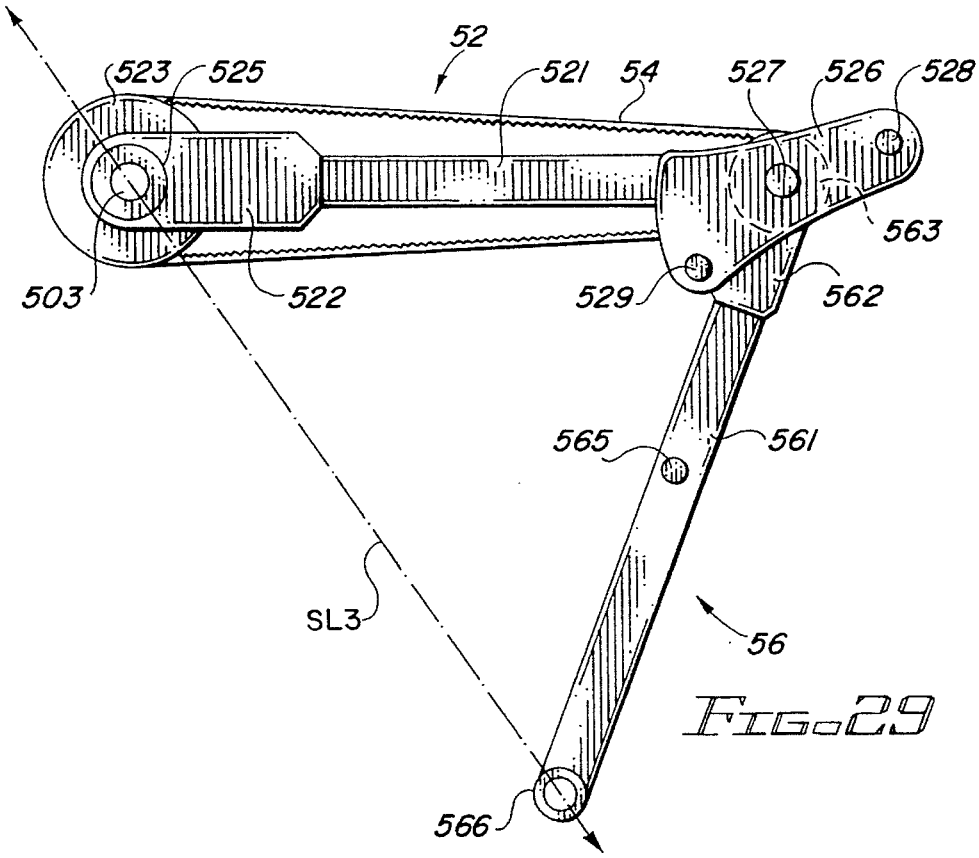
Figures 28B, 28D:
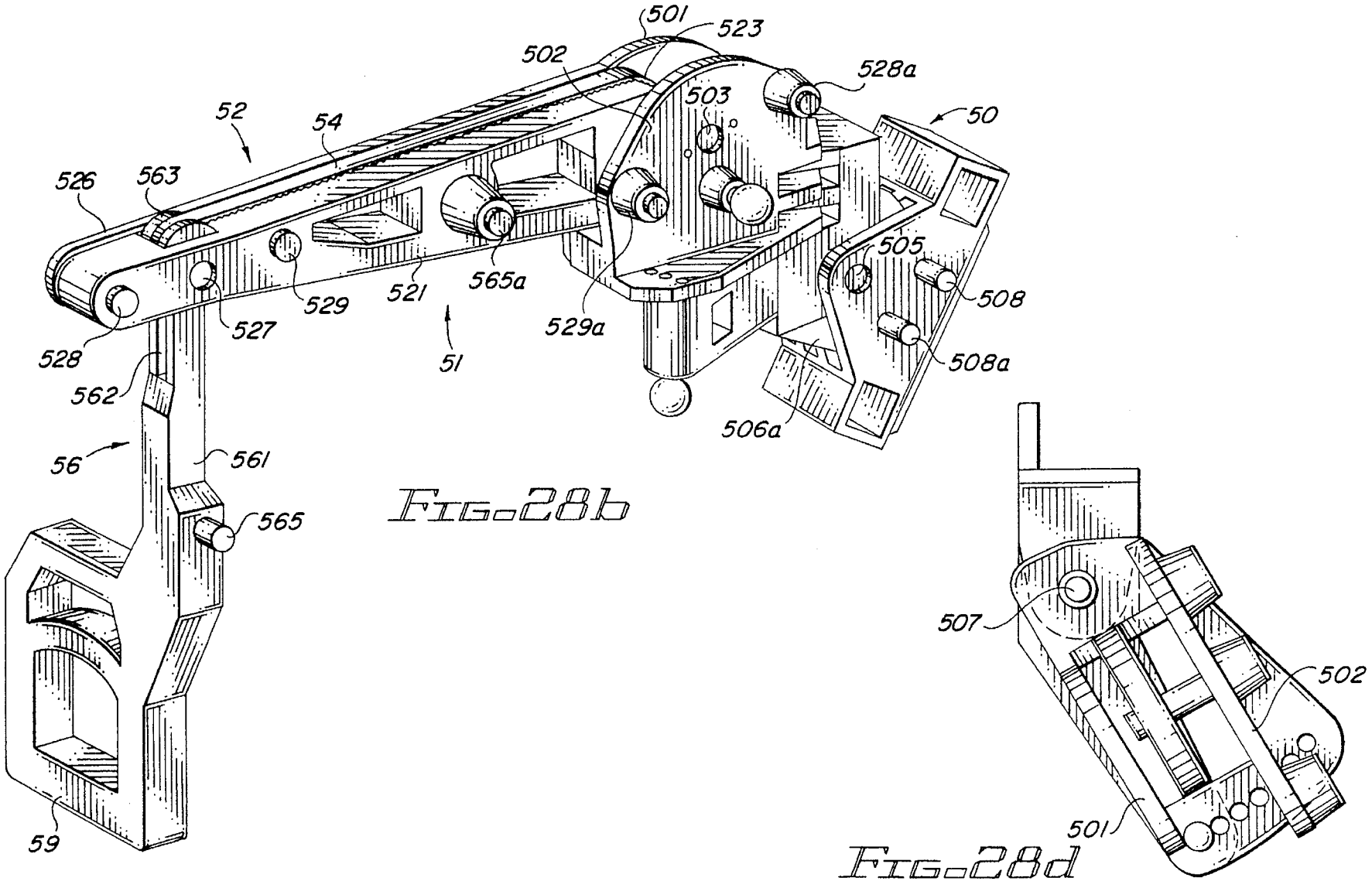
Figure 28C:
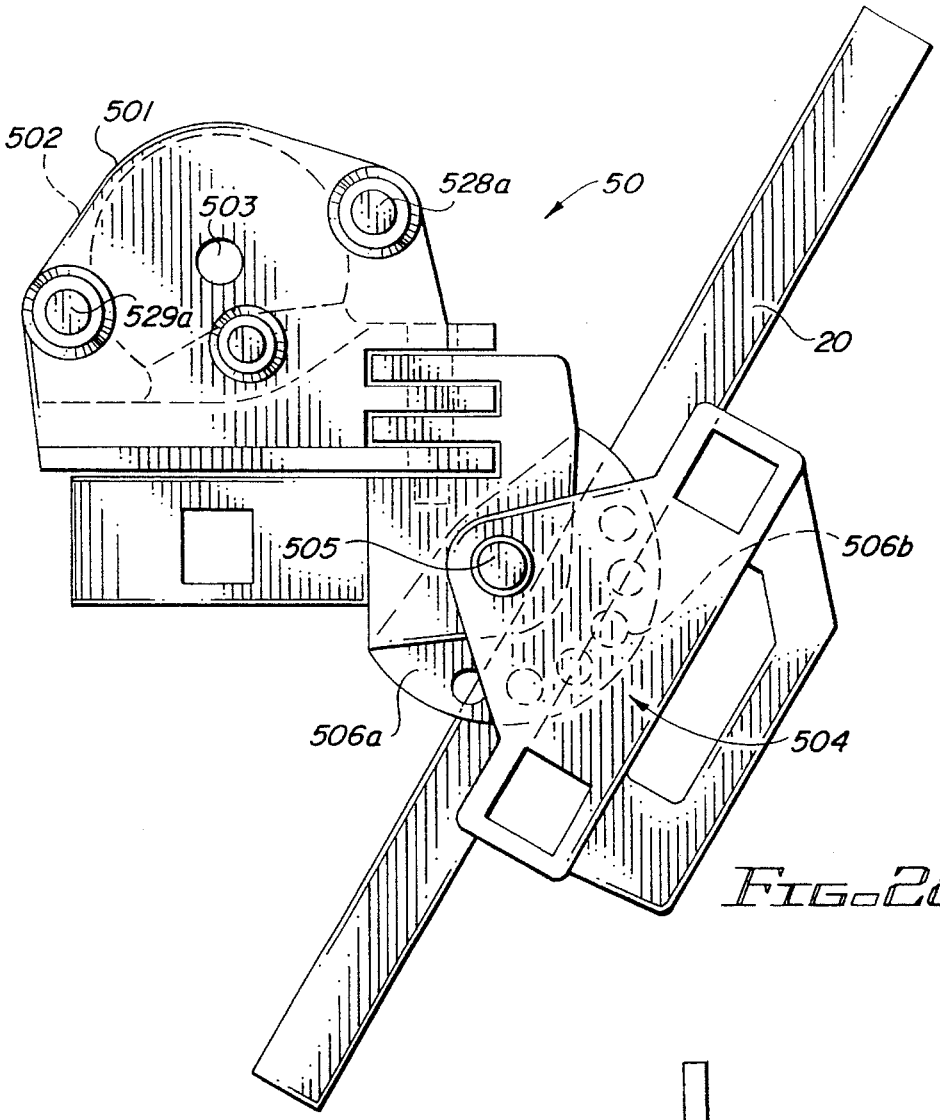
Figure 28E:
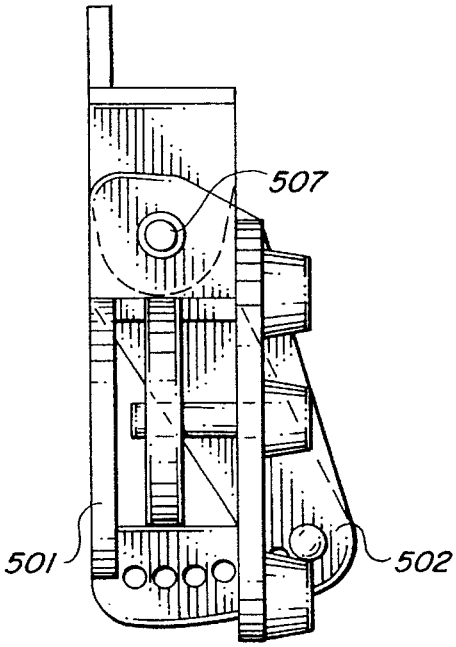
Figure 30:
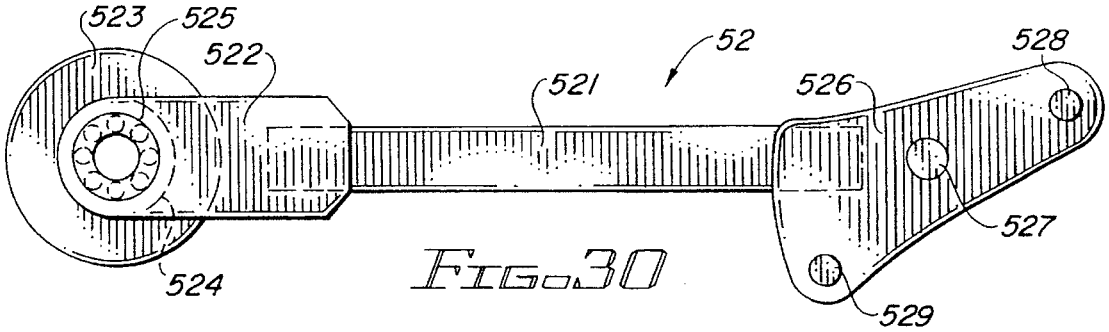
Figure 31:
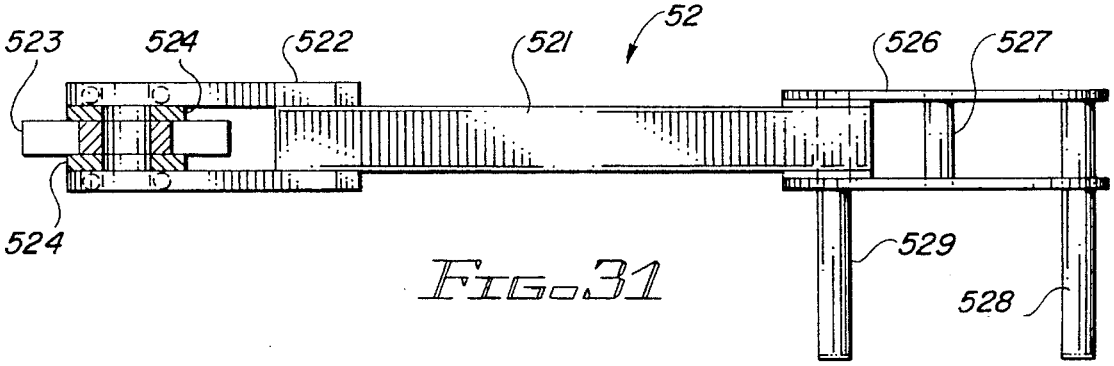
Figure 32:
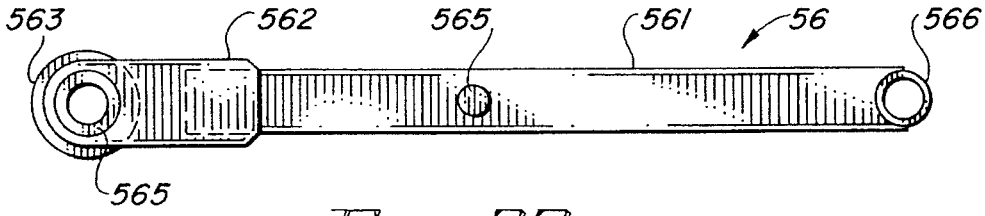
Figure 33:
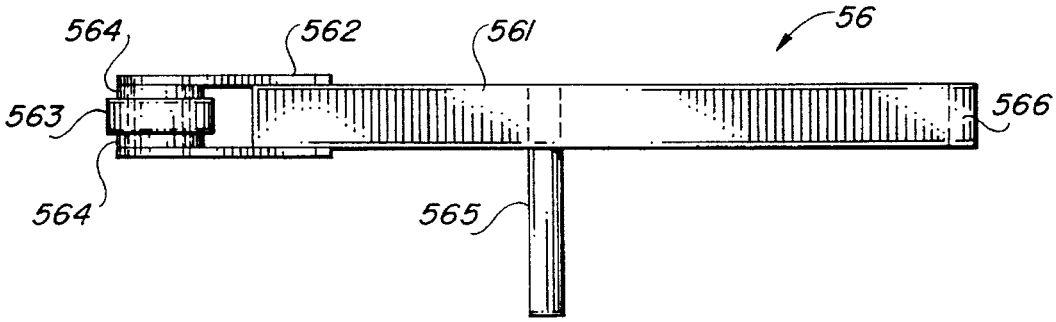
Figure 34:
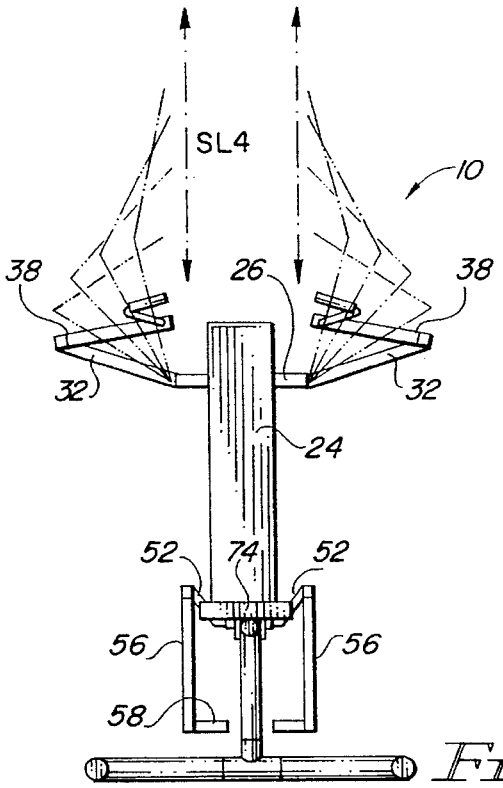
Figure 35:
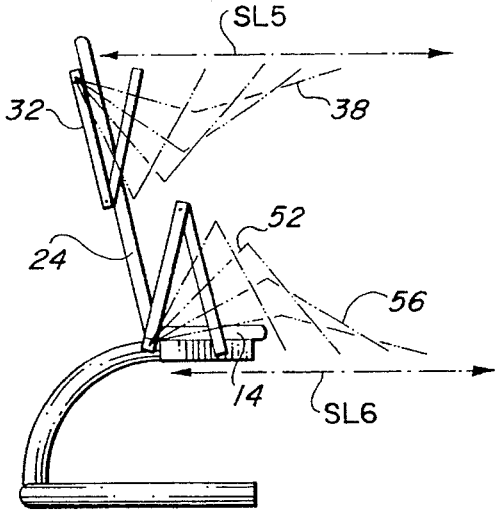
Figure 36:
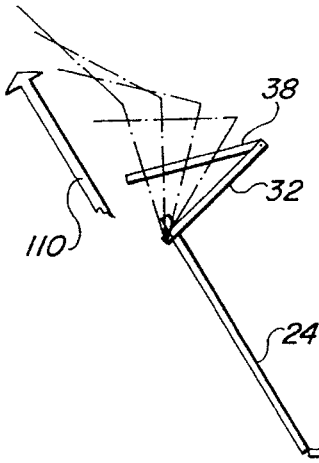
Figure 37:
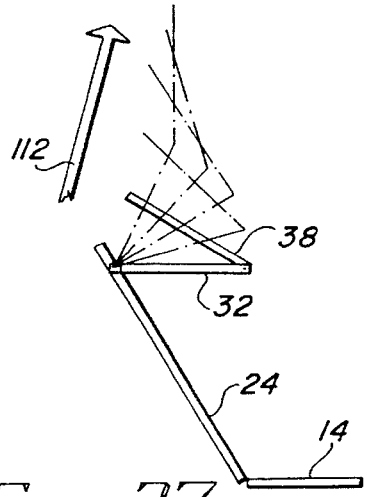
Figure 38:
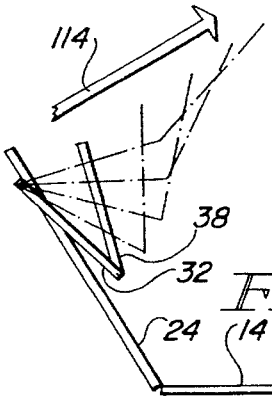
Figure 39:
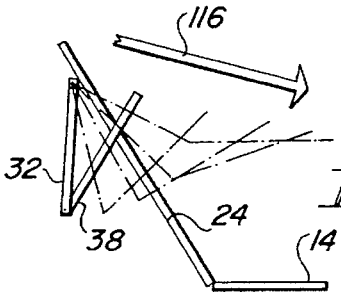
Figure 46:
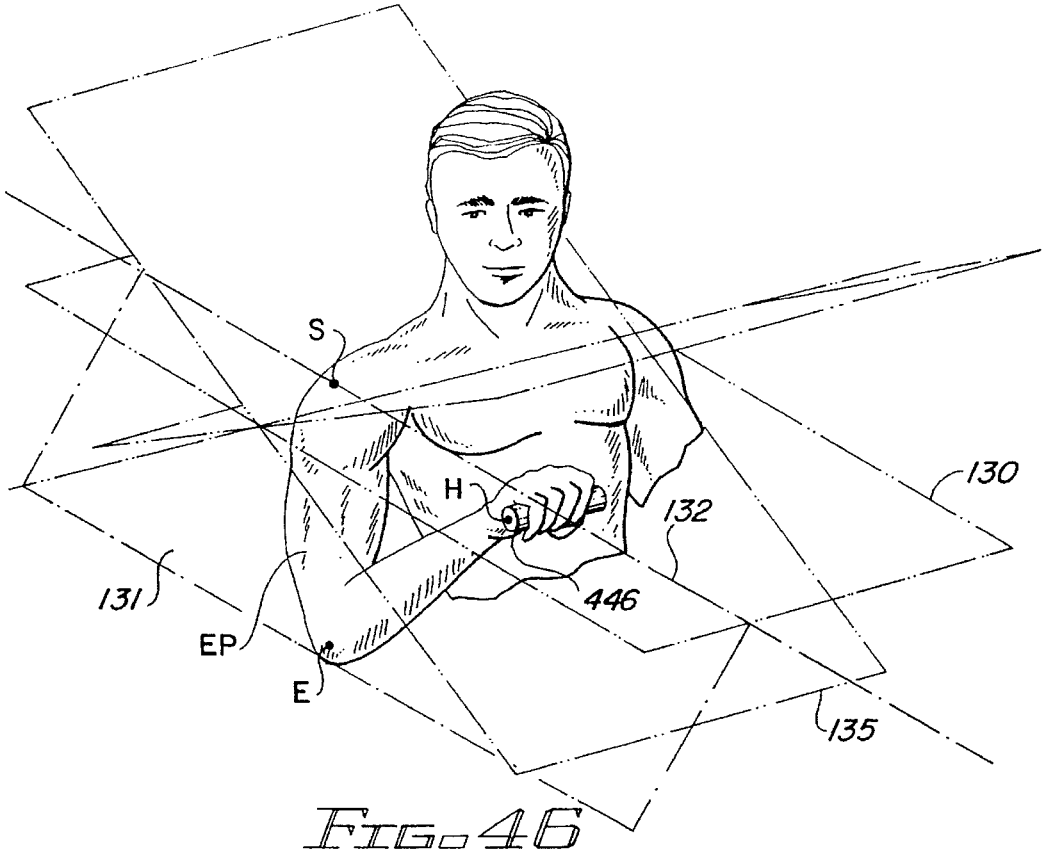
Figure 47:
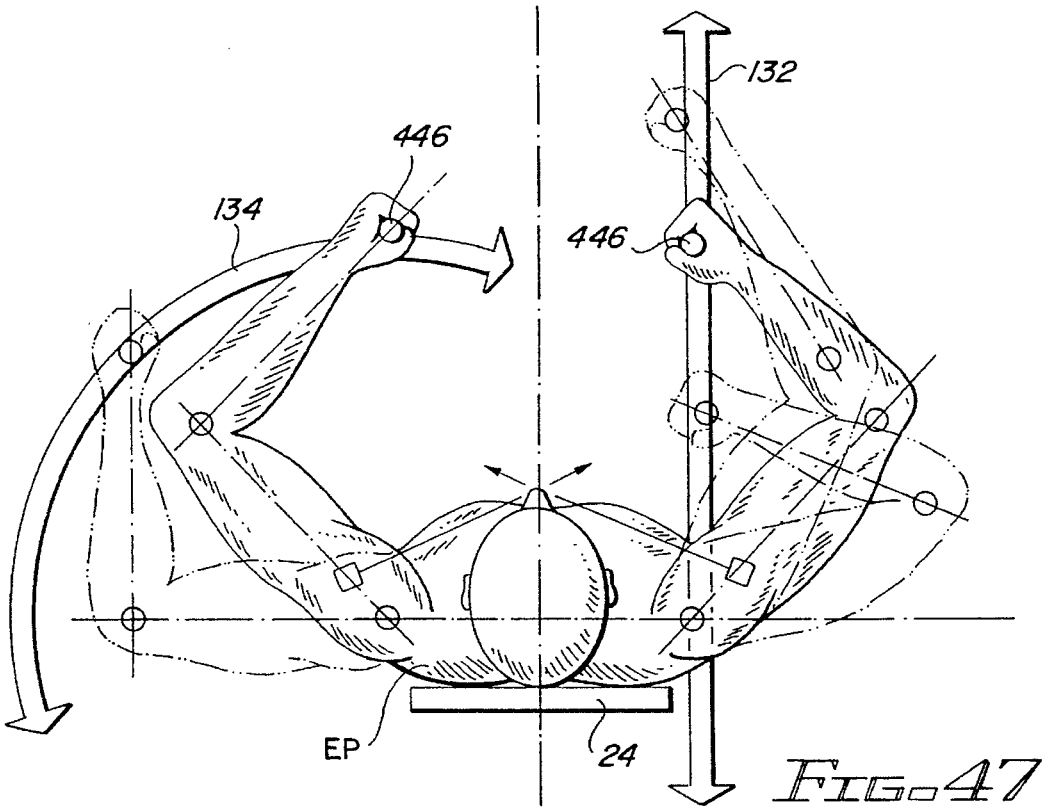
Figure 48A:
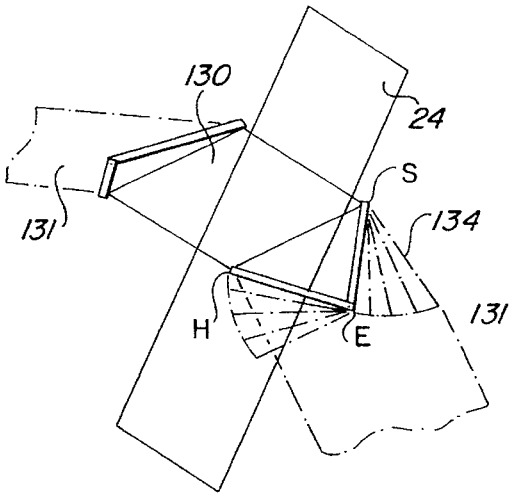
Figure 48B:
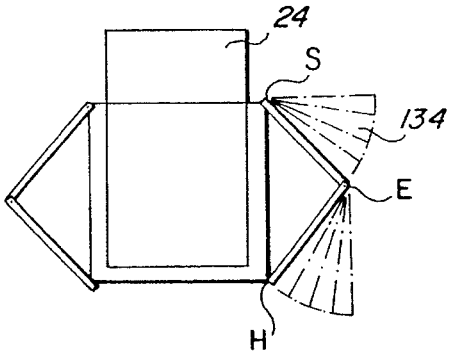
Figure 48C:
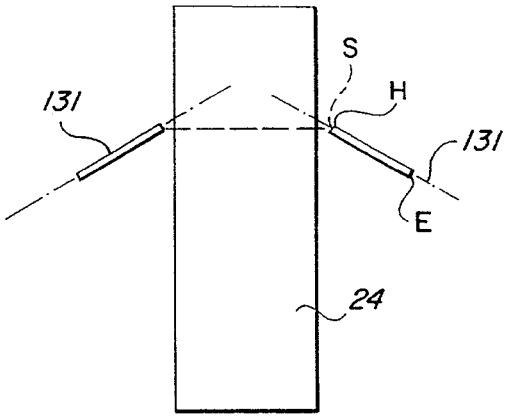
Figure 48D:
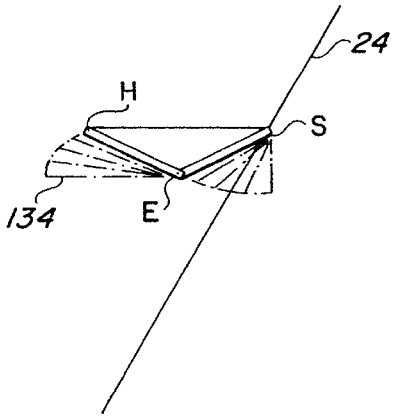
Figure 49A:
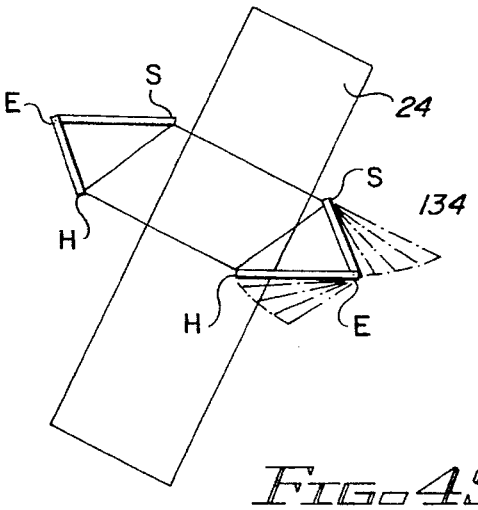
Figure 49B:
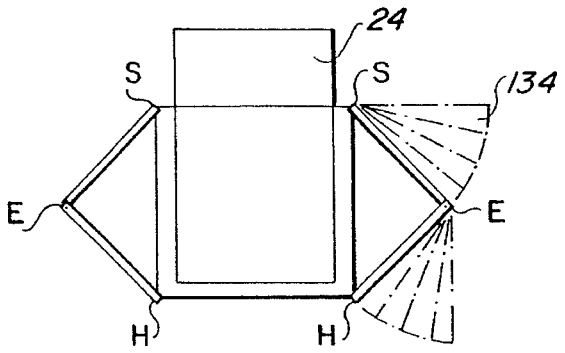
Figure 49C:
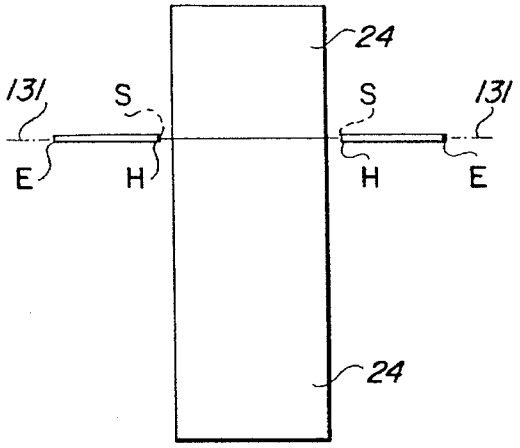
Figure 49D:
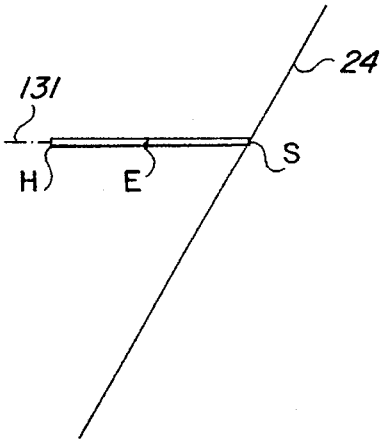
Figure 50A:
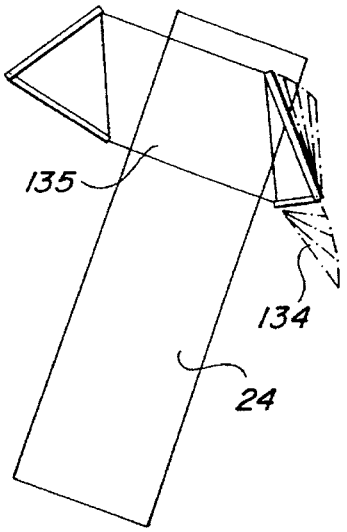
Figure 50B:
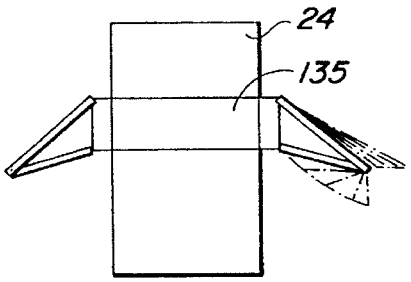
Figure 50C:
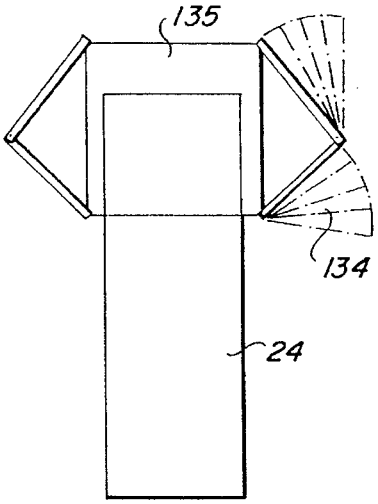
Figure 50D:
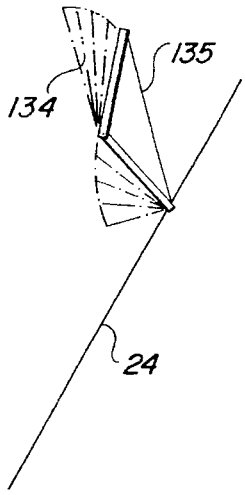
Figure 51A:
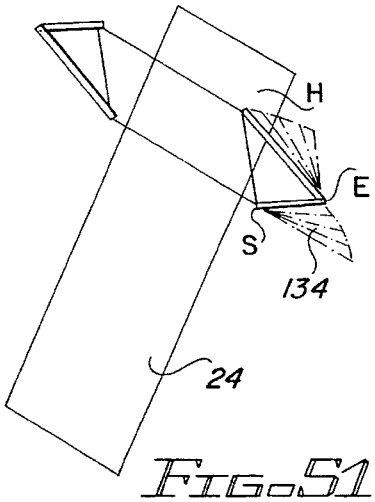
Figure 51B:
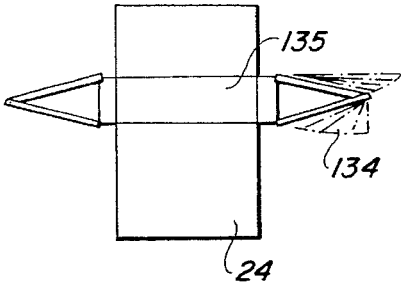
Figure 51C:
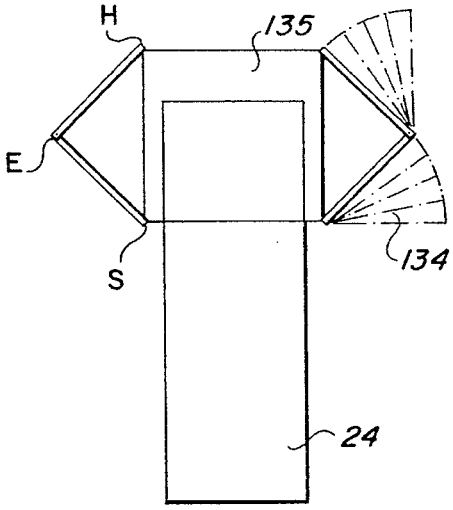
Figure 51D:
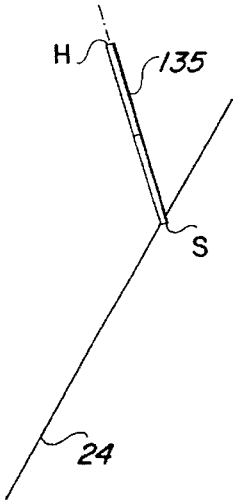
Figure 52A:
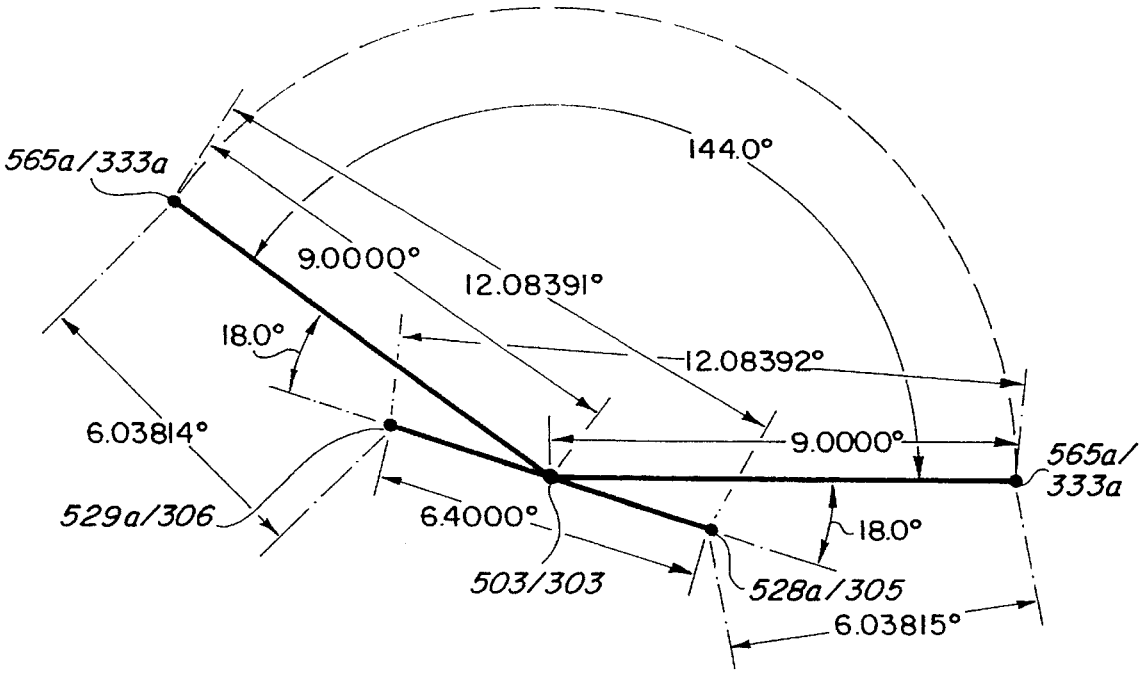
Figure 52B:
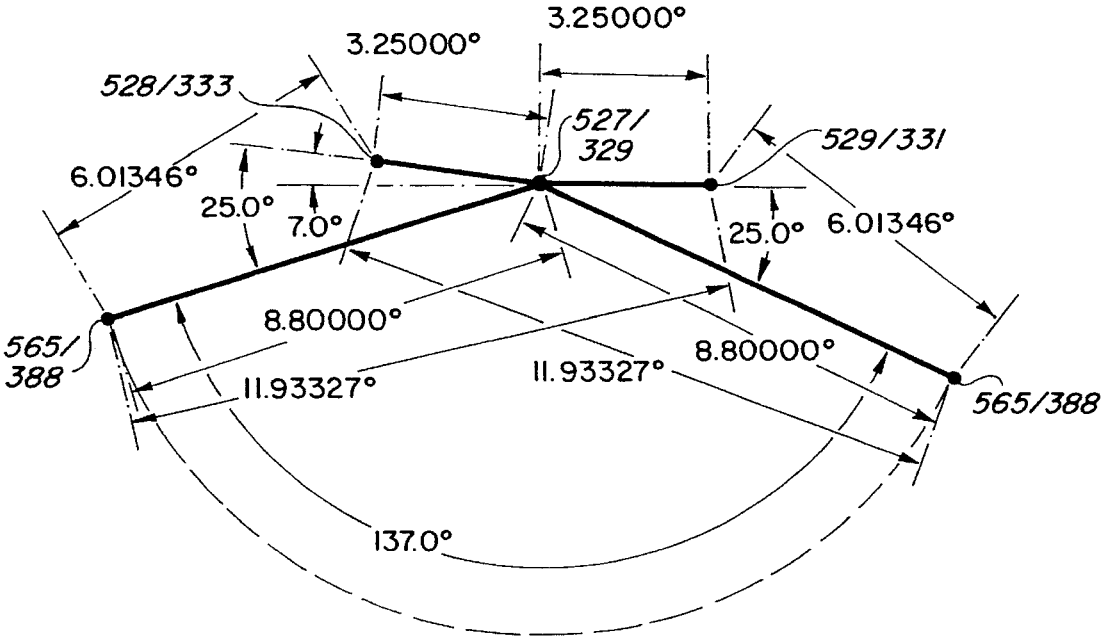

FIGS. 14*a*, 14*b*, 15 and 16 are perspective views illustrating the arm assemblies of the system and apparatus of the present invention with FIG. 14b illustrating the preferred embodiment;

FIG. 17 is a side view of the shoulder bracket and arm assembly;

FIGS. 18 and 19 are side and top views of the first, upper arm segment of the exercise arm assemblies depicted in FIGS. 14–17;

FIGS. 20 and 21 are side and top views respectively of the second, forearm segment of the exercise arm assembly shown in Figures;

FIGS. 22 and 23 are perspective and front views respectively of an exercise hand grip useful with the exercise arm assemblies shown in FIGS. 14–21;

FIGS. 24 and 25 are respective side and front views illustrating a hip joint assembly for the leg assemblies of the present invention, which leg assemblies are depicted in detail in FIGS. 28–33;

FIGS. 26 and 27 are perspective views illustrating different positions of the hip joint assembly with respect to the exercise system;

FIGS. 28*a*, 28*b* and 29 are perspective and side views, respectively, of an exercise leg assembly useful with the exercise system, FIG. 28*b* illustrating the preferred embodiment;

FIGS. 28*c*, 28*d* and 28*e* are partial right side view and top views of the hop bracket of the present invention of FIG. 28*b* illustrating the preferred embodiment of the exercise leg assembly;

FIGS. 30 and 31 are respective side and top views of a first, upper segment of the leg assembly shown in FIGS. 28 and 29;

FIGS. 32 and 33 are respective side and top views of the second, lower segment of the exercise leg assemblies of FIGS. 28*a* and 29;

FIGS. 34 and 35 are schematic illustrations showing the manner of operation of the exercise system;

FIGS. 36–45 illustrate certain of the exercises which can be performed on the system and apparatus shown in FIGS. 1–35;

FIG. 46 and 47 are perspective and top views illustrating features of the exercise system;

FIGS. 48*a*–48*d* illustrate the relation between exercise and arm planes in top left perspective, top plan, front elevation, and side elevation views;

FIG. sets 49*a*–49*d*, 50*a*–50*d* and 51*a*–51*d* illustrate alternate relationships as described in FIGS. 48*a*–48*d* in similar perspective, top, front and side views respectively; and FIGS. 52*a* and 52*b* illustrate linear and angular relationship between leading prior points of the preferred embodiment of the present invention.

In FIGS. 3–32, two-digit reference numerals are used to identify major components, and three-digit reference numerals are used to identify specific features of a major component having a corresponding designation represented by the first two digits of the three-digit number (for example, in FIGS. 3–7, reference numeral 28 refers to a shoulder assembly, while reference numeral 282 refers to the indexing plates which form a part of the shoulder assembly 28).

DETAILED DESCRIPTION OF THE PREFERRED EMBODIMENT

The major components of the exercise system 10 will be first described with reference to FIGS. 3*a*–4*b*, which is then followed by a detailed description of each major component as illustrated in FIGS. 5–32.

Figure 1:
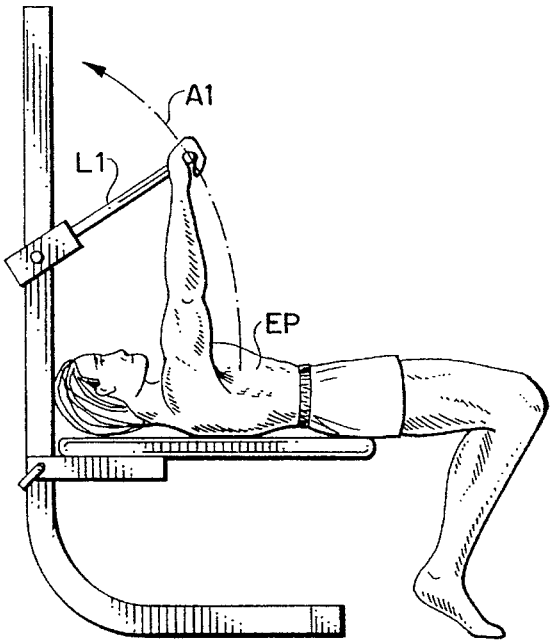
FIG. 1 (PRIOR ART)
Figure 2:
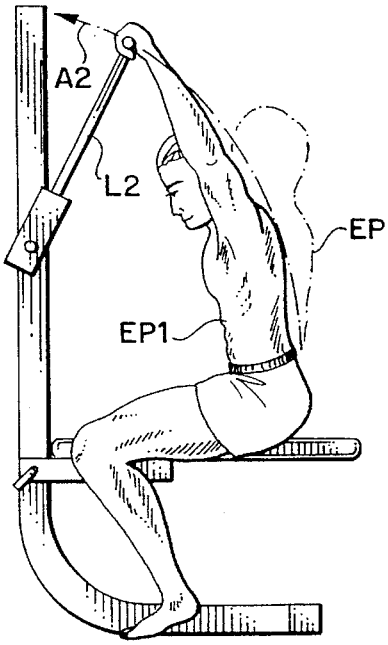
FIG. 2 (PRIOR ART)
Figure 4A:
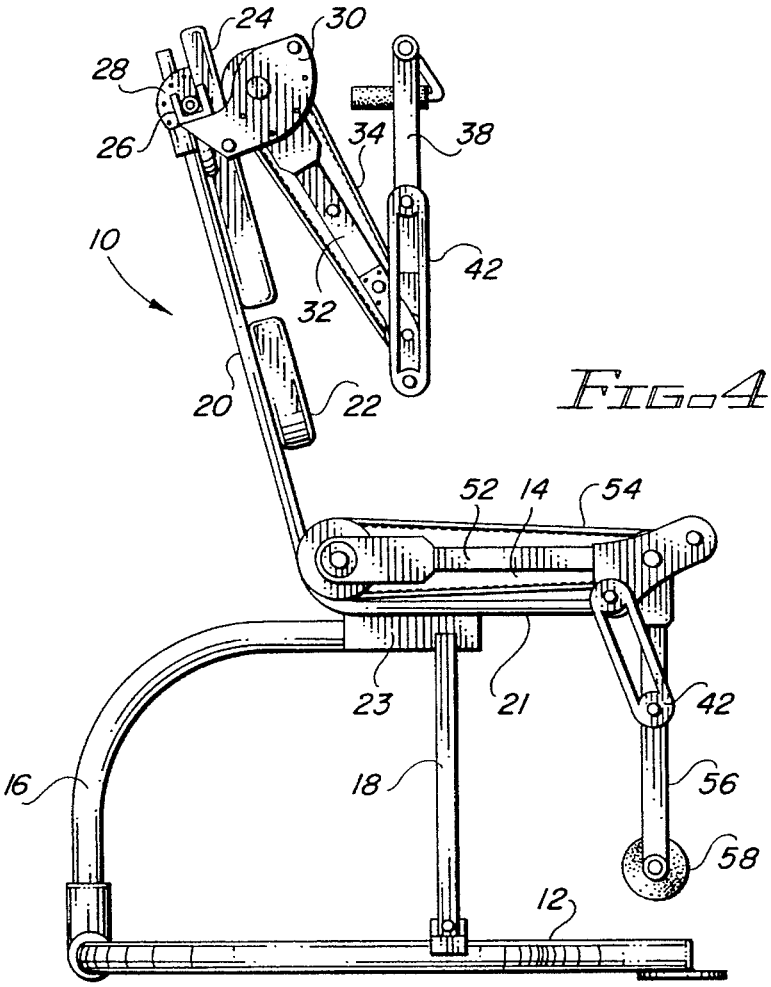
Figure 3A:
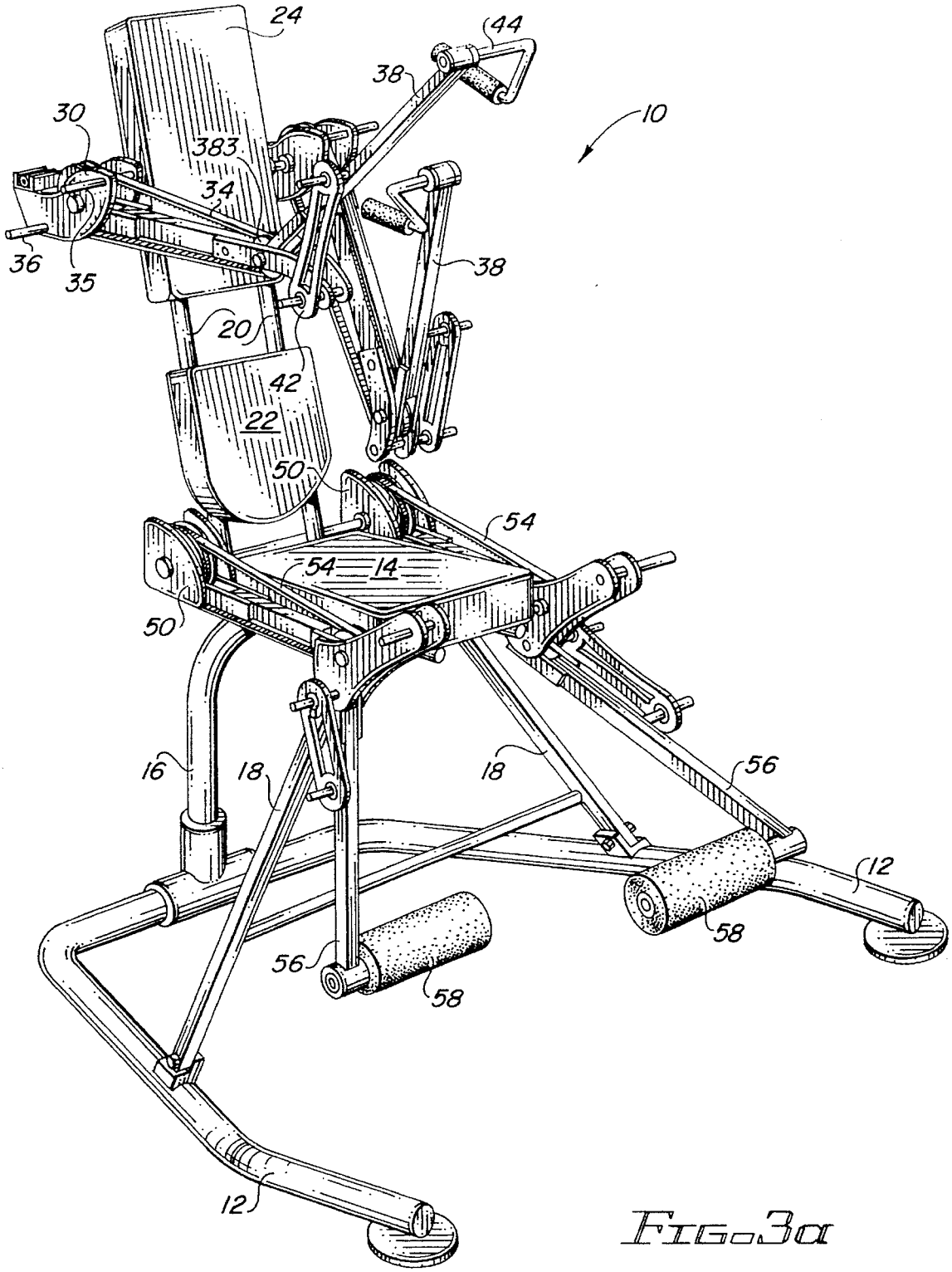
Figure 3B:
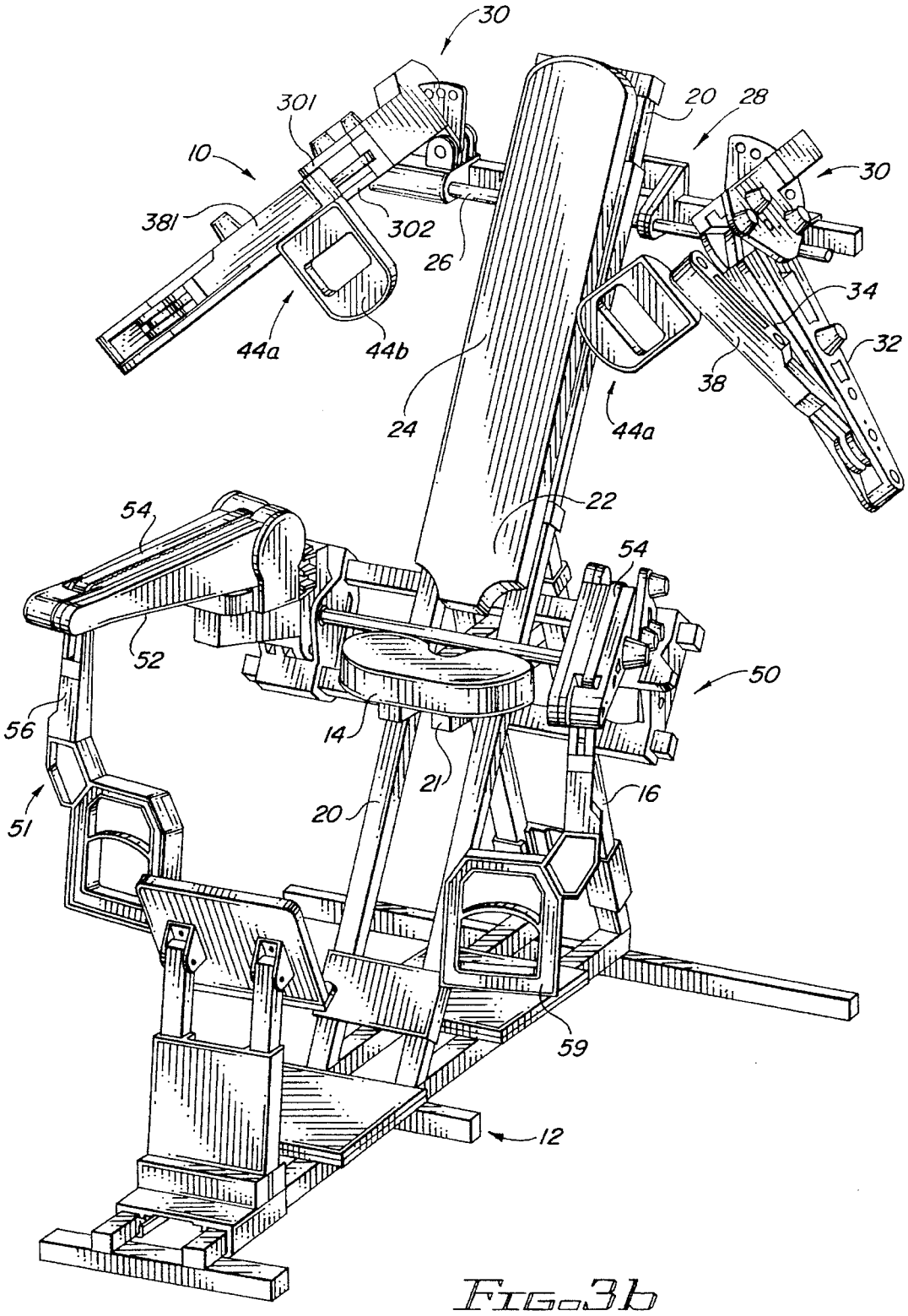
Figure 4B:
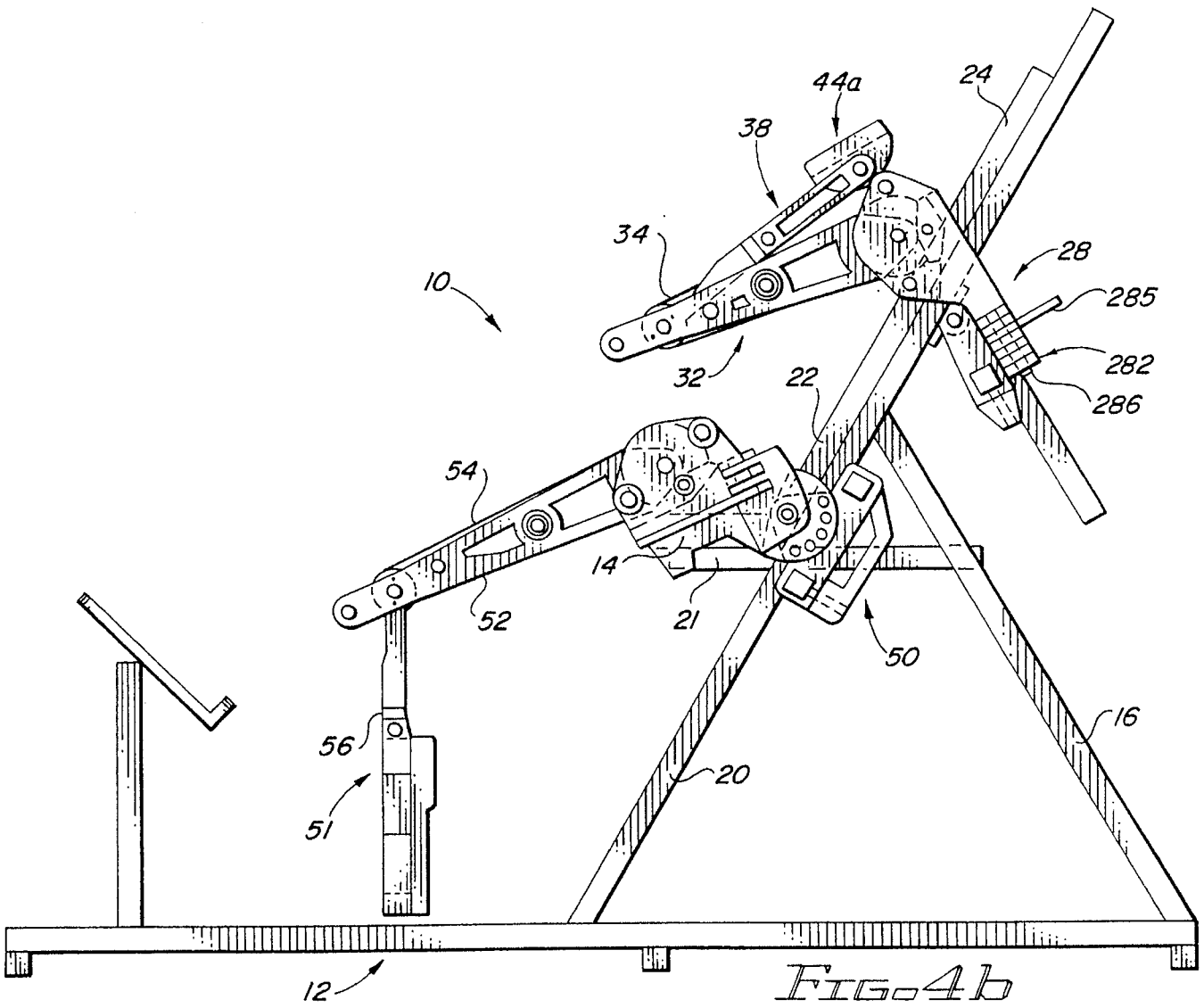
Figure 5:
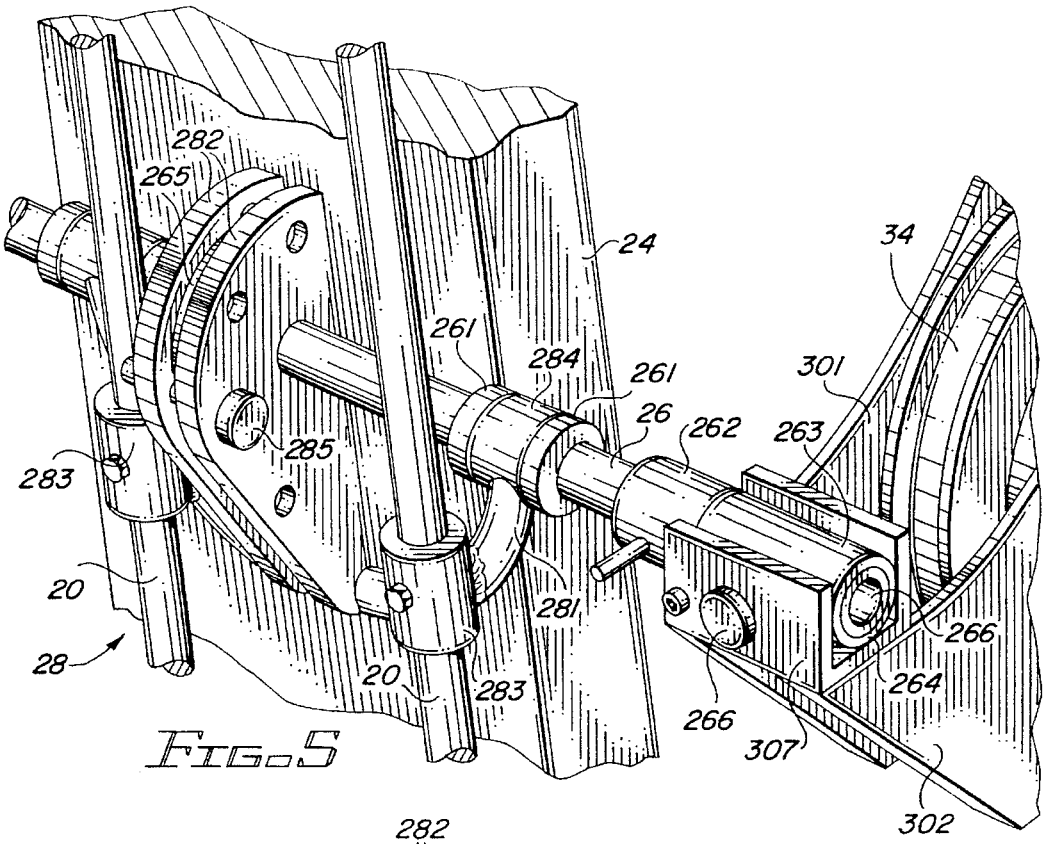
FIGS. 5–8 are perspective, top, front and side views, respectively, illustrating the rotatable shoulder support component of the system and apparatus of the present invention.
Figure 6:
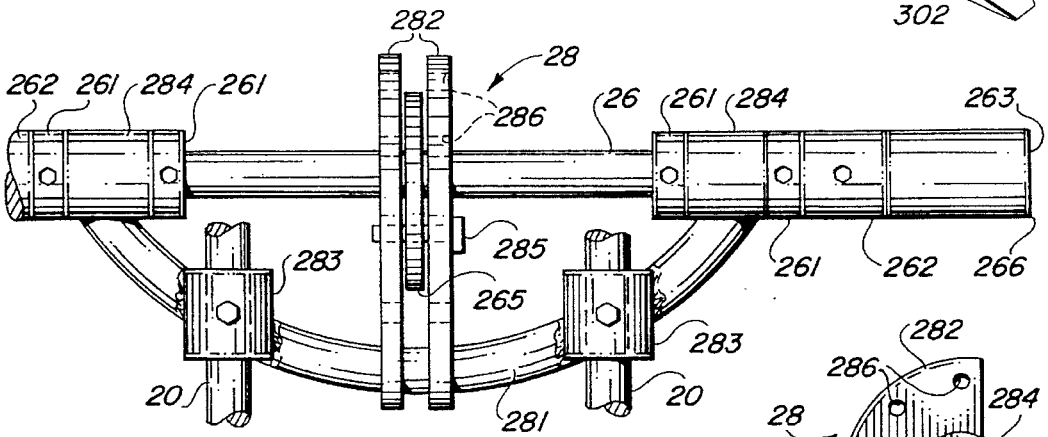
Figure 7:
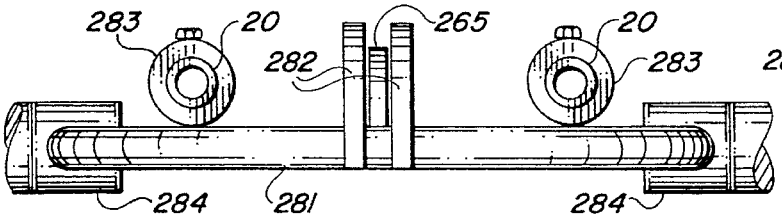
Figure 8:
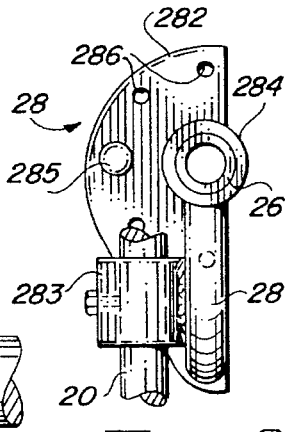
Figure 9:
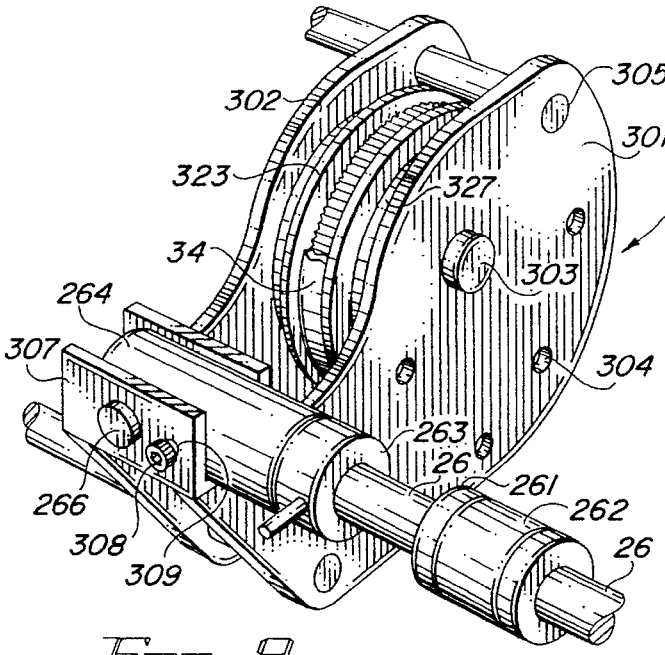
FIGS. 9 and 10 are perspective views.
Figure 12:
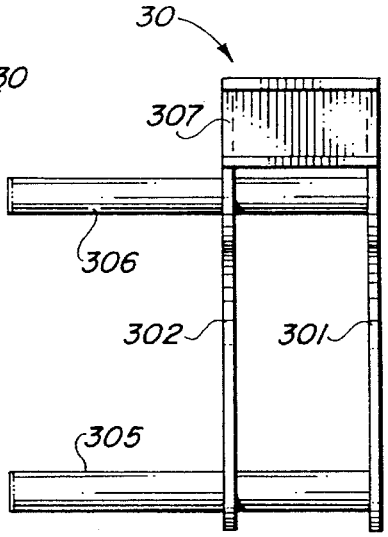
FIGS. 11, 12 and 13 are side, top and end views, respectively, of the shoulder bracket assembly of the system and apparatus of the present invention.
Figure 11:
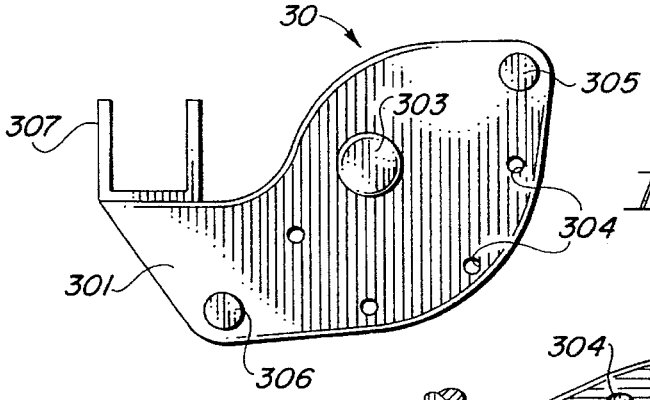
Figure 13:
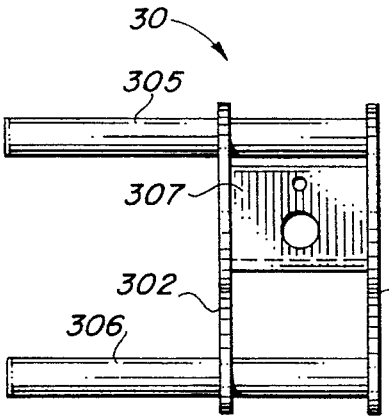

Turning now to FIGS. 3*a*–4*b*, the exercise system 10 of the present invention includes base supports 12, a seat 14, a back stanchion 16 and struts 18 for the embodiment of FIGS. 3*a* and 4*c* extending between the base supports 12 and the seat 14. The stanchion 16 and struts 18 extend to a lower frame support 23 for the embodiment of FIGS. 3*a* and 4*a*, upon which rests horizontal supports 21, which in turn support the seat 14. In the preferred embodiment of the present invention as illustrated in FIGS. 3*b* and 4*b*, the seat 14 is affixed to the horizontal support 21 which in turn is affixed to the vertical support 20. In the embodiment of FIGS. 3*a* and 3*b*, the horizontal supports 21 are integrally formed with vertical supports 20. A lumbar pad 22 and a back rest 24 are attached to the vertical support 20. In the preferred embodiment of FIGS. 3*a* and 3*b*, the lumbar pad 22 is integrally formed within the backrest 24. A shoulder rod 26 is mounted through indexing plates of a shoulder assembly 28 to the vertical structural supports 20. The shoulder rod 26 generally restricts an exercise plane, to be addressed a detail later, to be pivoted about an axis through the shoulder muscle group. The particular form of construction of the shoulder rod, index plates and attachment with the vertical supports 20 is described in greater detail below with reference to FIGS. 5–8.

With continuing reference to FIGS. 3*a*–4*b*, the exercise system 10 further includes a pair of shoulder brackets 30 each of which are mounted on the respective right and left extremities of the shoulder rod 26. Construction details of the shoulder bracket 30 are described below with reference to FIGS. 9–13.

In accordance with the present invention, the exercise system 10 is provided with a pair of exercise arm assemblies, each of which is attached to one of the shoulder brackets 30 along one side of the frame, including the vertical supports 20 and the back rest 24. Generally, each exercise arm assembly includes a first arm segment 32, a second arm segment 38 and an interconnecting positive linkage belt 34 between the first and second arm assembly segments. In order to provide the desired exercise tension, an elastomeric member 42 is attached between selected points on the first and second arm segments 32, 38 illustrated in FIGS. 3*a*–4*b* and elastomeric member 43 between the shoulder brackets 30 and first arm segment 32 in the present invention as illustrated in FIGS. 3*b* and 4*b*. A hand grip assembly 44 is attached at the outer extremity of the second arm segment 38. The construction details for the arm assembly are set forth below with reference to FIGS. 14–21, and the details of the hand grip 44 are described with reference to FIGS. 22 and 23.

With continued reference to FIGS. 3 and 4, the exercise system 10 also includes a second pair of exercise arm assemblies, each of which is mounted along the seat 14. Since the second pair of exercise arm assemblies are used principally for permitting the exercise of leg muscles, then this second pair of arm assemblies are referred to more specifically as the "leg assemblies"; however, as will be understood from the further description of the leg assemblies and the interconnected hip joint assemblies, all depicted in FIGS. 24–32, these are closely related in design to the shoulder and exercise arm assemblies described above and depicted in FIGS. 9–21.

Each leg assembly 51 includes a first leg segment 52 and a second leg segment 56 pivotably coupled to the first leg segment, with a positive linkage belt 54 coupling the two leg segments together via a sprocket arrangement. Each leg assembly is coupled to a corresponding one of the horizontal support rails 21 alongside the seat 14, as is more fully described below with reference to FIGS. 24–27. The particular details of each leg assembly are thereafter described with reference to FIGS. 28*a*–33. Each leg assembly also includes elastomeric tensioning bands 42, and an extension pad 58 as illustrated in FIG. 3*a* or stirrip 59 as illustrated in FIGS. 3*b* and 28*b* for the preferred embodiment for engaging the foot of the person undertaking the exercise upon the exercise systemg 10.

Each of the major components of the exercise system 10 will now be described with reference to the corresponding drawing figures.

Shoulder Rod Assembly

Turning now to FIGS. 5–8, the index plate shoulder assembly 28 has a pair of spaced indexing plates 282 which are coupled to the rear surface of the back rest 24. The indexing plates 282 include spaced apart indexing holes 286, which are dimensioned to receive an indexing pin 285. A pair of collars 283 are supported by a stanchion 281 extending across the rear surface of the back rest 24, with one of the vertical supports 20 extending through and fastened with a corresponding collar 283. Additionally, a pair of collars 284 are fixed on the ends of the stanchion 281, with the shoulder rod 26 extending through the collars 284, the indexing plates 282 and an indexing member 265, described below.

The shoulder rod 26 includes fastening collars 261 on either side of the support collar 284, a spacer collar 262, and an end cylinder 263. Each end cylinder 263 has a lateral joint 264 through which extends a pivot rod 266, for joinder of the shoulder bracket 30, as described in greater detail below with reference to FIGS. 9 and 10.

The shoulder rod 26 also has a fixed central indexing member 265 which is fixed to the shoulder rod 26 between the two indexing plates 282.

It will be appreciated by those skilled in the art that the shoulder rod 26 may be rotated by removal of the indexing pin 285, to thus permit the indexing member 265 to be rotated together with the shoulder rod 26 to a new position, at which time the indexing pin 285 may be inserted through a desired indexing hole 286 to thereby change the angular position of both shoulder brackets 30 (and thus both of the exercise arm assemblies), as is desired by the person engaging in the exercise program.

In general, the assemblies of the preferred embodiment of the exercise system 10 as illustrated with reference to FIG. 3*b* are analogies to the assemblies herein described and earlier presented in the parent application. Improvement guided by cost effective manufacturing techniques and design choice have lead to the preferred embodiment herein presented. By way of example, the U-shaped bracket 307 still pivots about a pivot rod 266 but as illustrated in FIG. 14*b* is integrally formed as part of the shoulder bracket 30. Also, rotation of the exercise plane 130 discussed with reference to FIG. 46 remains about the shoulder rod 26. In the preferred embodiment of the present invention width adjustments between arm assembly pairs are made using a spring pin in communication with the adjustment rod 26*a* running generally parallel to the shoulder rod 26 again illustrated with reference to FIG. 14*b*.

Shoulder Bracket Assemblies

The shoulder bracket assembly 30 is described with reference to FIGS. 9–13, and FIG. 14*b*.

The shoulder bracket assembly 30 includes spaced, parallel bracket plates 301, 302 which are supported in a spaced apart condition by support rods 305, 306 and integrally cast as illustrated in the preferred embodiment of the present invention illustrated with reference to FIGS. 3*b* and 14*b*. (As shown in FIG. 3, the two rods 305, 306 may be used to store extra elastic tensioning bands 42.) Additionally, a rotation rod 303 extends between the two plates 301 and 302, and supports an upper arm sprocket 323 and adjacent bearing plates 327.

The shoulder bracket assembly 30 includes a U-shaped bracket 307 mounted so as to engage the extremity of a corresponding shoulder rod cylinder 263 by insertion of the pivot rod 266 through the bracket 307 (the specific construction details of the shoulder bracket assemblies 30 and the U-bracket are shown in FIGS. 11–13 and FIG. 14*b* for the preferred embodiment).

Figure 10:
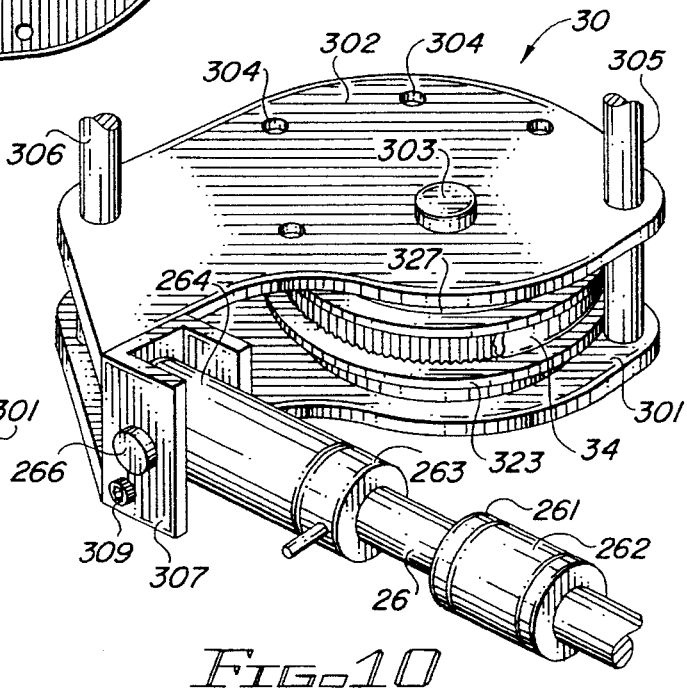

The shoulder bracket assembly 30 is capable of rotation about the pivot rod 266 between multiple positions, by removal of a locking pin 308 (not seen in FIG. 14*b*) from the U-bracket The position of the shoulder bracket assembly 30 after removal of the locking pin 308 and after rotation is shown by way of example in FIG. 10. As will be evident from the discussion of the left hand portion of FIG. 47 below, the rotation of the shoulder bracket assembly 30 permits the exercise arm assembly to be utilized for exercises which are in a plane lateral to the longitudinal axis of the body of the person exercising.

The plates 301 include plural, spaced holes 304 across the front periphery which are utilized with an indexing pin 328 (FIG. 17) to change the angular relationship of the exercise arm assembly 32, 38 (and thus, the restricted straight line and exercise plane) with respect to the person exercising.

Exercise Arm Assemblies

One form of the exercise arm assembly will now be described with reference to FIGS. 14*a*–21.

The exercise arm assembly includes a first, or upper, arm segment 32 and a second, or forearm segment 38 and an inner connecting positive linkage belt 34 between those two segments 32, 38.

Figure 15:
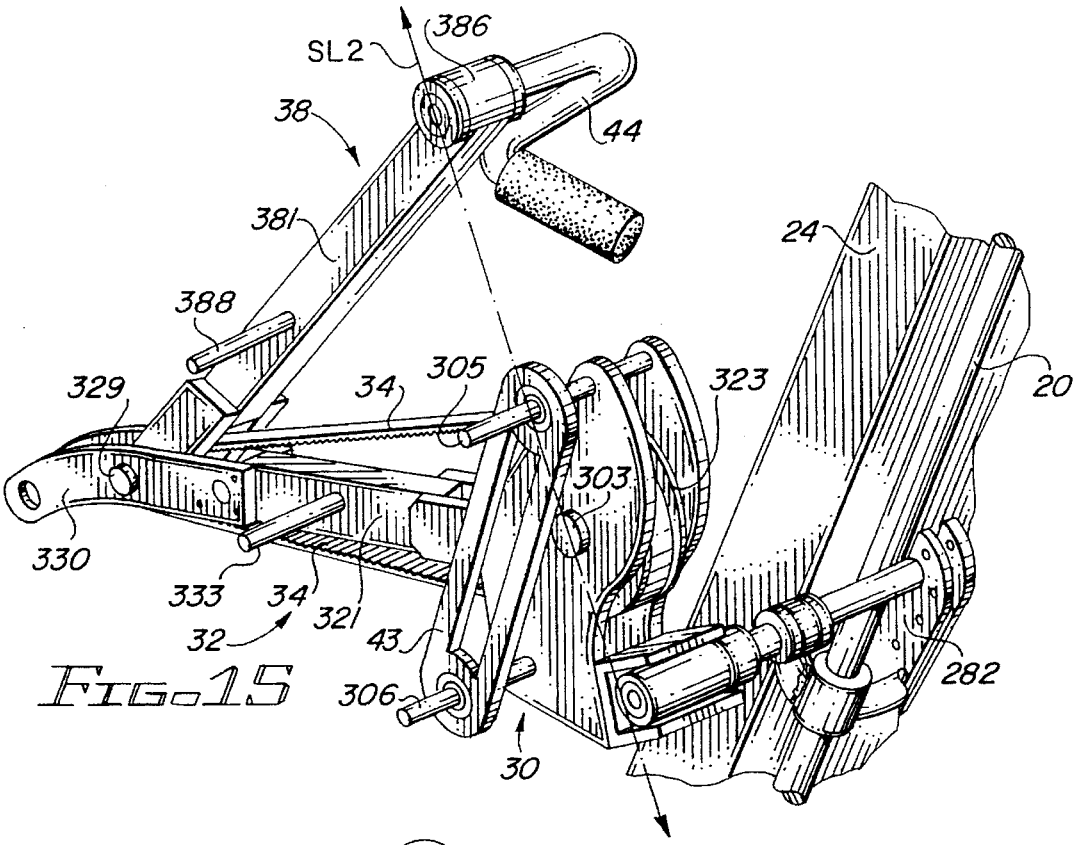
Figure 16:
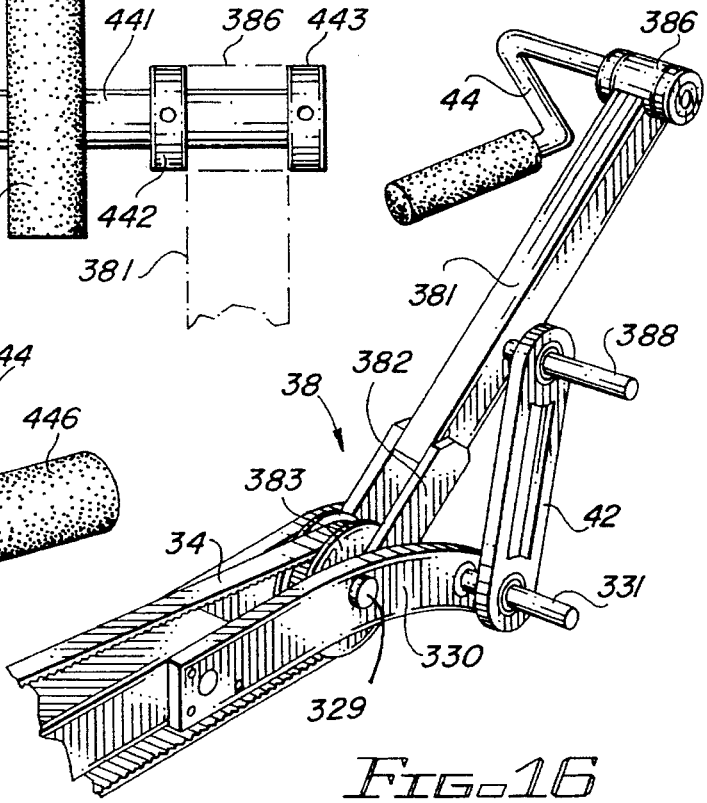

Noting FIGS. 14*a*–19, the upper arm segment 32 includes an intermediate arm portion 32 having a proximal end fork 322 formed of spaced parallel plates which support a rotatable toothed sprocket 323 and adjacent bearing assemblies comprising bearing plates 327, bearing housing 325 and roller bearings 326. The fork 322, bearing plates 327 and toothed sprocket 323 all define a central opening 324 through which the rod 303 extends to support the upper arm segment 32 with the shoulder bracket assembly 30 (note to FIGS. 14 and 15). The upper segment 32 includes a distal fork 328 defined by parallel plates attached to the distal end of the intermediate arm portion 321; the distal fork 328 includes a rod 329 between the plates, and further defines an extension 330 beyond the rod 329. Resistance member support pins 331, 332 and 333 are respectively attached to the extremity of the extension 330, to the intersection of the intermediate arm portion 321 and the distal fork 328, and centrally along the intermediate arm portion 321, as is shown in FIGS. 18 and 19. These three resistance elements support pins 331, 332 and 333 (333*a* for embodiment of FIG. 14*b*) are utilized together with similar pins 305 and 306 on the shoulder bracket assembly 30, and with another resistance element support pin 388 along the second, forearm segment 38 of the exercise assembly. One such arrangement is shown with the elastic resistance element 42 extending between pins 333 and 388, and is used to obtain negative resistance during movement of the exercise arm assembly. Another arrangement is shown in FIG. 16, with the exercise resistance band 42 between pins 331 and 388, in order to obtain a positive resistance to movement of the exercise arm assembly.

FIGS. 14*a*–17 and 20–21 also illustrate the second, forearm segment 38 of the exercise arm assembly. The forearm assembly 38 includes an intermediate arm portion 381 having a proximal end fork 382 defined by parallel plates supporting a toothed sprocket 383 and spacer plates 384. The fork 382, toothed sprocket 383 and plates 384 all include an opening 385 dimension to receive the pivot rod 329 (FIGS. 17 and 14*b*); further, the fork 382, plates 384 and sprocket 383, while rotating about the rod 329, are all fixed together by pins 389, shown by dotted lines in FIG. 21 (that is to say, while the toothed sprocket 383 rotates about rod 329, it rotates together with the entire forearm segment 38). In accordance with this invention, the upper arm sprocket 323 has a 2-to-1 toothed relationship with respect to sprocket 383, in order to achieve the desired straight line movement of the distal end of the forearm segment 38 through the center point of the pivot rod 303, as discussed in greater detail below.

The forearm segment 38 includes a journal 386 at its distal extremity for receiving the hand grip assembly 44 shaft shown in FIGS. 22, 23 and 3*b* for the embodiment introduced with this specification. The forearm segment 38 also includes a tension support pin 388 extending laterally from the intermediate arm portion 381 (note FIG. 21 and 14*b*).

As shown in FIGS. 14, 15 and 16, the toothed belt 34 extends around both sprockets 323 and 383, so that as the journal 386 of the forearm segment 38 is pushed away from, or pulled toward, the shoulder bracket assembly 30, the movement of the entire forearm segment 38 causes the toothed belt 34 to be rotated about the forearm segment sprocket 383; this in turn causes rotation of the upper arm sprocket 323. Because of the specific tooth relationship of the sprockets 323 and 383, the distal end of the forearm segment 38 is displaced only along a straight line, the direction of the line depending upon the angular relationship of the shoulder bracket assembly 30. One such straight line is shown in FIG. 14*a*, and designated as SLY; as can be seen, this first straight line SL1 is directed essentially lateral to the backrest of the exercise assembly 10. On the other hand, in FIG. 15, a second straight line SL2, is shown directly substantially upwardly at an acute angle with respect to the backrest 24, because the angular relationship of the upper arm assembly 32 has been changed by a movement of the pin 328 into an appropriate one of the adjustment holes 304 in the shoulder bracket assembly 30. The manner in which different constricted straight line movements may be used to achieve specific exercise benefits will be described below with respect to FIGS. 34–47.

With reference to FIGS. 14*b*, primary joint (shoulder) and secondary joint (elbow) loading is achieved for a pulling (tucking) movement and pushing (thrusting) movement by varying the loading (electronic member 43) between pins.

By way of example, loading the elastomeric member 43 between support pin 333*a* (a common insertion point), and pin 306 (a proximal origin point) will resist movement of the hand away from the shoulder and thus provide a pushing or thrusting exercise for the primary joint. Loading the elastomeric member 43 between the common insertion support pin 333*a* and pin 305 (a distal origin point) resists movements of the hand toward the shoulder and thus provide a pulling or tucking exercise movement.

In a similar manner and as earlier described, loading the elastomeric member 43 between support pin 388 (a common insertion point for the secondary joint exercise) and pin 353 (a proximal origin point) will resist movement of the hand away from the shoulder while loading the secondary joint and thus provide pushing forces. Loading common insertion pin 388 with pin 331 (a distal origin point) provides a pulling or tucking force. Such loading is provided singularly or in cooperating combination for providing varying exercises. As will be realized, similar loading is provided for the primary (hip) and secondary (knee) joints of the lower body as well with use of analogous loading points of the leg assembly 51 as will be discovered later.

Hand Grip Assembly

The hand grip assembly 44 will now be described with reference to FIGS. 22 and 23. The hand grip assembly 44 in one embodiment, includes a rod 441 extending through the distal end member forearm assembly 38, and is supported therein with collars 442 and 443. A first extension member 444 is joined to the rod 441 at its inside end, and extends angularly and downwardly toward the outside of the exercise system 10 (note FIGS. 3*a* and 34). A second extension member 445 then extends from the extremity of the first member 444 and toward the back support 24, and includes a hand grip 446 along the second member 445. As will be understood from a review of FIG. 23, the entire hand grip assembly 44 rotates freely around the distal end of member 386 of the forearm assembly 38, and with the hand grip 446 lying approximately in the same planes as that distal end member. This construction facilitates the straight line restriction exercise techniques which are achieved by the system 10 of the present invention. Similarly, the grip assembly 44*a* of the preferred embodiment presented herein provides for this restriction and multiple exercises not requiring the straight line restriction.

Hip Joint Assembly

The hip joint assembly of the exercise system 10 will now be described with references to FIGS. 24–27 including the current embodiment of FIG. 3*b* and assemblies illustrated with reference to FIGS. 28*b*–28*e*. The hip joint assembly, referred to generally by the reference numeral 50, has a construction and method of operation which is quite similar to the shoulder joint assembly 30 shown in FIGS. 9–13.

The hip joint assembly 50 includes a pair of parallel plates 501, 502 with a pivot rod 503 extending between those plats. A U-shaped bracket 504 having a pivot rod 505 extending across its respective arms is attached and extends laterally to the direction of the plates 501, 502. As is shown in FIGS. 26 and 27, the U-shaped bracket 504 is attached by a pivot rod 505 to the extremity of a collar 506 attached to the end of a hip rod 507. The hip rod 507 is in turn attached to the seat support 21. In use, the hip joint assembly may be rotated between an upright position as shown in FIG. 26, to a lateral position as shown in FIG. 27 through removal of a pin 505*a* (FIG. 26), to permit the hip joint assembly 50 to rotate between those two positions.

In the preferred embodiment illustrated with reference to FIGS. 3*b* and 4*b* assemblies of FIGS. 28*b*–28*d*, a selector mechanism 506*a* pivots about pivot rod 505 wherein multiple rotated positions are selected by inserting pins 508 through holes 504*a* within the walls of the bracket 504 which communicate with holes 506*b* within the perimeter of mechanism 506*a* for rotating about an axis through rod 505 and locking into a preselected position corresponding to a selected hole 506*b*.

Movement between the leg assembly pair is along a pair of square tubes receiving the U-shaped bracket 504 as illustrated with reference to FIGS. 28*b* and 28*c* and locked in placed with a spring pin (not shown) as described earlier with reference to the shoulder bracket assembly 30.

Further, plates 501, 502 are rotatable about an axis wherein a selector mechanism as described for the hip joint above provides adjustment for an angle between leg assemblies. Numerals of the preferred embodiment illustrated in FIG. 28*b* are selected for analogous elements of the embodiment as originally filed for emphasizing function. As discussed earlier, manufacturing assemblies as molded integral units has proven to be cost effective without compromising the objects of the present invention. FIGS. 28*d* and 28*e* illustrate a portion of the hip bracket of the present invention in two angled positions.

Exercise Leg Assembly

The details of the exercise leg assembly will be described with reference to FIGS. 28*a*–33. In these figures, major assembly reference numeral 52 refers to the upper, or thigh segment of the exercise leg assembly, and reference numeral 56 refers to the lower, or calf segment of the exercise leg assembly.

Referring first to FIGS. 28*a*–31, the thigh segment 52 of the exercise leg assembly 51 includes an intermediate leg segment 521 with a fork 522 at its proximal end formed by parallel plates which extend between the plates 501, 502 of the hip joint assembly, and are rotatably supported by the pivot rod 503 (note also FIGS. 26 and 27). With reference to the preferred embodiment of FIGS. 28*b* and 28*c*, the thigh segment 52 of the exercise leg assembly 51 includes an intermediate leg segment 521 which extends at its proximal end between plates 501 and 502 for pivoting about pivot rod 503 and includes the rotatable sprocket 523 as earlier described. The thigh segment 52 includes a rotatable toothed sprocket 523 also supported axially on the pivot rod 503, and is separated from the parallel forks 522 by bearing plates 524 (note FIGS. 30 and 31).

The thigh segment 52 also includes a parallel fork 526 at its distal end defined by parallel plates with a pivot pin 527 extending between the two plates of the fork 526. A pair of exercise tension pins 528 and 529 extend across the fork 526, one located below the distal extremity of the intermediate portion 521 along the fork 526 (pin 529) and the other pin 528 located at the distal extremity of the fork 526.

The calf segment 56 of each exercise leg assembly has a construction essentially identical to the forearm segment 38 of the exercise arm assemblies described above. As shown in FIGS. 32 and 33, the calf segment 56 includes an intermediate portion 561 having a parallel fork 562 at its proximal end with a toothed sprocket 563 with rotatable about pivot pin 527 (FIGS. 28*a* and 28*b* ) and with fixed spacer pads 564 between the sprocket 563 and the sides of the fork 562. An exercise tension support pin 565 extends laterally from the intermediate portion 561 and the distal end of the intermediate portion 561 has a bearing block 566 for supporting a conventional foot rest extending laterally and inwardly from the calf segment 56, as shown in FIG. 3.

As shown in FIGS. 26–29, a toothed belt 54 extends around the sprockets 523, 563 and with the sprockets arranged in the 2-to-1 ratio described above with respect to the exercise arm assembly. In this manner, and as is shown in FIG. 29, the movement of the distal end 566 of the calf segment 56 toward or away from the center line defined by pivot rod 503 of the proximal end of the thigh assembly 52 is only along a straight line SL3, thus achieving the desired restricted movement of the exercise leg assembly 51 in accordance with this invention, and is described in greater detail in the next section.

Again with reference to FIG. 28*b* and as was described earlier with reference to loading the primary and secondary joints of the upper body, consider loading pins 565 (a common insertion secondary joint), 528 (a distal origin), and 529 (a proximal origin). Loading the elastomeric member 43 between pins 565 and 529 will resist movement of a foot inserted at extension 59 (stirrip) away from the hip while loading the secondary joint (knee) and requires a pushing force. Loading common insertion pin 565 with 528 requires a pulling force for the exercises being performed.

In a similar manner, comparable pins of the primary joint provide comparable exercises. By way of example, affixing the elastomeric member 43 between common insertion pin 565*a* of the hip joint and distal origin pin 528*a* provides the pulling exercise for the primary joint, and placement of the member 43 between the common insertion pin 565*a* and the proximal pin 529*a* will resist movement of the foot away from the hip while loading the primary joint (hip) thus providing a pushing exercise. As was described earlier with reference to the upper body, combinations of loading provide multiple exercise routines.

Manner of Operation

FIGS. 34 and 35 schematically illustrate how the exercise system 10 may be utilized to restrict the direction of exercise along a straight line SL4, and thereby carefully control the plane of exercise for a particular muscle group. In FIG. 34, straight line SL4 which provides a restrictive line of resistance either away from or toward the seat 14 in a generally vertical direction. If the resistance to movement along the restricted straight line 8L4 is in a direction toward the seat 14, then a "pushing" exercise is achieved; on the other hand, if the elastic tensioning bands 42 are disposed on the system 10 in a manner so as to achieve resistance of movement along the restricted straight line SL4 in a direction away from the seat 14, then a "pulling" exercise is achieved.

Similarly, as is shown in FIG. 35, adjustment of the tensioning bands for movement along straight line SL5 will achieve a "pushing" exercise if resistance to movement along the restricted straight line SL5 is toward the back rest 24, whereas a "pulling" exercise is achieved if resistance to movement along restricted straight line SL5 is away from the back rest 24.

Figure 40:
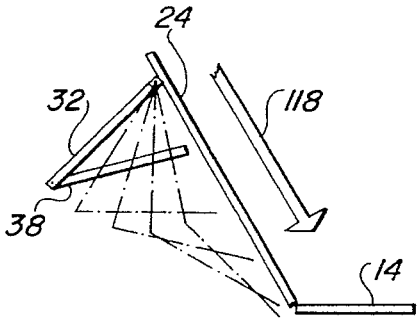
Figure 41:
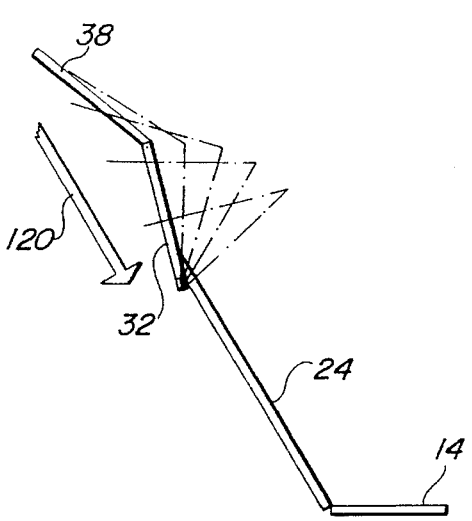
Figure 42:
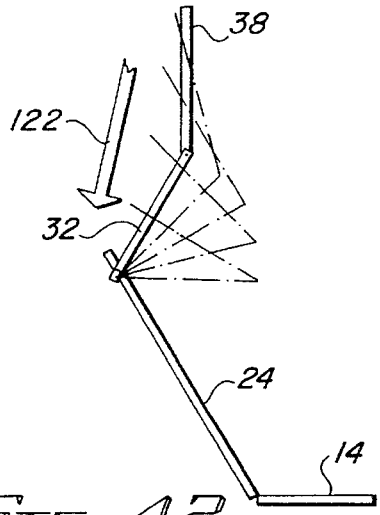
Figure 43:
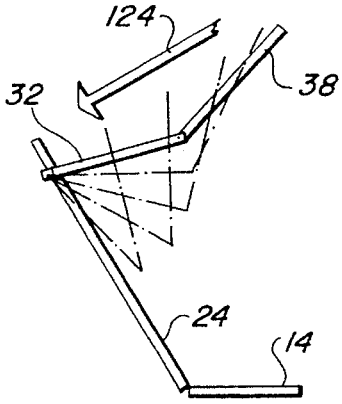
Figure 44:
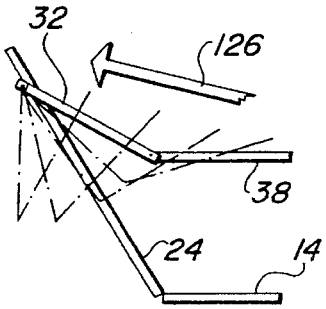

FIGS. 36–40 illustrate five different restricted straight lines 110, 112, 114, 116 and 118, all of which may be achieved as restricted straight lines of exercise by rotation of the shoulder assembly 30 through movement of the indexing plates 282, caused by changing the position of the indexing pin 285 to various indexing holes 286 (FIGS. 5–8). As is shown in FIGS. 36–40, the direction of exercise is in a direction away from the seat 14 and back rest 24 with the five exercises in FIGS. 36–40 being generally defined as follows: triceps military press (FIG. 36); triceps incline press (FIG. 37); triceps bench press (FIG. 38); triceps decline press (FIG. 39); and triceps dip (FIG. 40).

Figure 45:
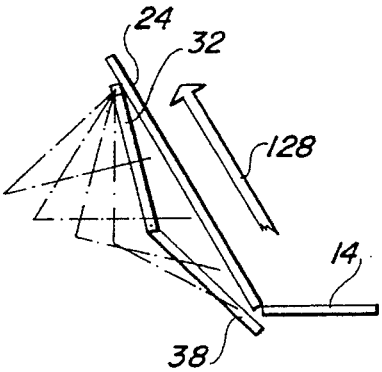

As is shown in FIGS. 41–45, an entirely different series of exercises are achieved by simply changing the resistance of bands 42 so that the exercise is in a direction generally toward either the seat 14 or back rest 24, as is illustrated by straight lines 120, 122, 124, 126 and 128. These five exercises are generally described as: chin up (FIG. 41); incline row (FIG. 42); flat row (FIG. 43); decline row (FIG. 44); and upright row (FIG. 45). Similar exercises are achieved for the lower body by rotation and movement of the leg assemblies about the hip joint assembly as earlier described.

FIG. 46 is a perspective illustration showing an exercising person EP using one exercise arm assembly having a hand grip 446 which is used to direct the exercise along a restricted exercise plane 130 passing through the shoulder muscles containing restricted straight line of exercise 135. As was described previously with respect to FIGS. 36–45, the exercise system 10 may be adjusted to thereafter permit the restricted straight line 132 to "Y" in a second (or third, etc.) plane 134.

Noting FIG. 47, the exercise system 10 has the ability to achieve the restricted straight line movement as shown with respect to straight line Z32, or alternatively be rotated at the shoulder bracket via U-shaped bracket 307 and indexing pin 308 (FIGS. 9 and 10) to permit the shoulder bracket assembly 30 to be rotated at an outward angle, and achieve a conventional curved displacement of the hand grip 446, as is shown by curved line 134 on the left side of FIG. 47; however, in accordance with the present invention, curved line 134 lies in a restricted arm plane 131.

Further consider the above described exercise movements where, with continued reference to FIG. 46, the straight line 132 lies within exercise plane 130, and shoulder hand and elbow are restricted to movement within the arm plane 131. The present invention as herein described permits rotation of the arm plane 131 about the straight line 132.

By way of example, the apparatus 10 provides for selecting various plane aspects from a generally horizontal exercise plane 130 with angled left and right arm planes 131 relative to the exercise plane 130 as illustrated with reference to FIGS. 48*a*–48*d* and FIGS. 49*a*–49*d* wherein the arm plane 131 is coplanar with the exercise plane 130. Movement of the shoulder(S) hand (H) and elbow (E) are restricted to within the arm plane 131 no matter what angle the arm plane 131 makes with the exercise plane 130 and rotation of the arm plane 131 is always confined about an axis of rotation that is the straight line 132. By way of further example, FIGS. 50*a*–51*d* illustrate alternate combinations of inclined exercise planes 135 and arm planes 131 while indicating free or curved movement 134 radial lines from the shoulder joints. In a similar manner, the primary and secondary joints of the lower body are taken through the same exercise movements where the movements desired for shoulder (S), hand (H) and elbow (E) are preferred by the hip, foot and knee. FIGS. 52*a* and 52*b* illustrate typical movement between pin locations including typical linear and angular dimensions for the preferred embodiment of the present invention.

Sample Exercise Regimen Using Exercise System 10

Through empirical analysis, it has been determined that a proper alignment of the restricted straight line movement for different exercises achieves an optimal exercise regimen. By way of example, a regimen is cataloged below in relation to the closest traditional exercise:

| Closest "Traditional" Exercise | Proper Alignment |
|---|---|
| I. DOUBLE JOINT MOVEMENTS - UPPER BODY | |
| Elbows In - Pushing | |
| 1 Triceps Military Press | 170° from body line |
| 2 Triceps Incline Press | 125° from body line |
| 3 Triceps Bench Press | 80° from body line |
| 4 Triceps Decline Press | 45° from body line |
| 5 Triceps Dips | 5° from body line |
| Elbows Out - Pushing | |
| 6 Military Press | 170° from body line |
| 7 Incline Press | 125° from body line |
| 8 Bench Press | 80° from body line |
| 9 Decline Press | 45° from body line |
| 10 Wide Grip Dips | 5° from body line |
| Elbows In - Pulling | |
| 11 Biceps Pulldown | 170° from body line |
| 12 Biceps Incline Pulldown | 125° from body line |
| 13 Biceps Row | 80° from body line |
| 14 Biceps Decline Row | 45° from body line |
| 15 Biceps Upright Rows | 5° from body line |
| Elbows Out - Pulling | |
| 16 Wide Lat Pulldown | 170° from body line |
| 17 Incline Lat Pulldown | 125° from body line |
| 18 Wide Grip Row | 80° from body line |
| 19 Wide Decline Row | 45° from body line |
| 20 Wide Upright Rows | 5° from body line |
| DOUBLE JOINT MOVEMENTS - LOWER BODY | |
| Leg Press/Squats | |
| 21 Seated Leg Press | 67.5° from body line |
| 22 Decline Leg Press | 37.5° from body line |
| 23 Incline Squat | 15° from body line |
| Abdominal/Knee Lifts | |
| 24 Seated Knee Lift | 67.5° from body line |
| 25 Decline Knee Lift | 37.5° from body line |
| 26 Reverse Squat | 15° from body line |
| II. SINGLE JOINT MOVEMENTS - UPPER BODY | |
| Adductor Flyes - Arms Out/Fly in | |
| 27 Military Flyes | 170° from body line |
| 28 Incline Flyes | 125° from body line |
| 29 Flat Flyes | 80° from body line |
| 30 Decline Flyes | 45° from body line |
| 31 Upright Lat Flyes | 5° from body line |
| Abducter Flyes - Arms in/Fly out | |
| 32 Lat Flye Pulldown | 170° from body line |
| 33 Incline Rear Delt Flyes | 125° from body line |
| 34 Rear Delt Flyes | 80° from body line |
| 35 Decline Rear Delt Flyes | 45° from body line |
| 36 Lateral Delt Flyes | 5° from body line |
| Upper Arm | |
| 37 Isolated Biceps Curls | |
| 38 Isolated Triceps Extensions | |
| III. SINGLE JOINT MOVEMENTS - LOWER BODY | |
| Upper Leg | |
| 39 Isolated Leg Extensions | 67.5° from body line |
| 40 Isolated Leg Curls | 67.5° from body line |
| 41 Hip Flexion | |
| 42 Hip Extension | |
| 43 Seated Hip Adduction | 67.5° from body line |
| 44 Decline Hip Adduction | 37.5° from body line |
| 45 Lateral Hip Adduction | 15° from body line |
| 46 Seated Hip Abduction | 67.5° from body line |
| 47 Decline Hip Abduction | 37.5° from body line |
| 48 Lateral Hip Abduction | 15° from body line |
| Lower Leg | |
| 49 Seated Calf Raises | 67.5° from body line |
| 50 Decline Calf Raises | 37.5° from body line |
| 51 Calf Presses | 15° from body line |

This concludes the description of embodiments of the present invention. A reading by those skilled in the art will bring to mind various changes without departing from the spirit and scope of the invention. It is intended, however, that the invention only be limited by the following appended claims.

What is claimed is:

1. An exercise apparatus comprising:

an exercise frame;

an exercise assembly having:

a proximal end coupled to the frame and a distal end;

a first pivot member rotatably connecting the exercise assembly proximal end to the frame, the first pivot member having an axis of rotation perpendicular to a frame side portion, the first pivot member permitting the exercise assembly to be radially offset from the frame side portion along the first pivot member axis;

a second pivot member rotatably connecting the exercise assembly proximal end to the first pivot member for rotation about a second pivot member axis perpendicular to the first pivot member axis, the second pivot member permitting the exercise assembly to be offset from the first pivot member axis;

a first arm segment having a proximal end forming a part of the exercise assembly proximal end and a distal end forming a part of the exercise assembly distal and;

a third pivot member rotatably connecting the first arm segment proximal end to the exercise assembly proximal third pivot member having an axis of rotation perpendicular to the second pivot member axis, the third pivot member permitting rotation of the first arm segment about the third pivot member and within an exercise assembly plane of rotation defined by a combination of an angular position of the exercise assembly proximal end rotated about the first and second pivot members;

a second arm segment having proximal and distal ends;

a fourth pivot member rotatably connecting the second arm segment proximal end to the first arm segment distal end the fourth pivot member having an axis of rotation parallel to the third pivot member axis of rotation, the second arm segment thus rotatable about the fourth pivot axis within the exercise assembly plane;

a grip assembly; and a fifth pivot member within the second arm segment distal end, the fifth pivot member having an axis of rotation parallel to the third and fourth axes of rotation, the fifth pivot member rotatably connecting the grip assembly to the second arm segment distal end for rotation of the grip assembly about the fifth pivot member and within the exercise assembly plane;

means for limiting movement of the assembly first and second arm segments within the exercise assembly plane; and means for applying an exercise resistance to movement of the exercise assembly distal end about the proximal end, the movement within the exercise plane.

2. The apparatus recited in claim 1 wherein the exercise resistance means applies a resistance to rotational movement of the first arm segment about the third pivot member.

3. The apparatus according to claim 1 wherein the exercise resistance means applies a resistance to rotational movement of the second arm segment about the fourth pivot member.

4. An exoskeletal exercise apparatus comprising:

an exercise frame including an upstanding back rest;

a pair of exercise arm assemblies, each arm assembly supported along one side of the back rest and having a proximal end adjacent the back rest and a distal end, the arm assembly further having first and second segments with one of the first segments including the proximal end and one end of the second segment including the distal end, the first and second segments coupled together at a pivot intermediate between the arm assembly proximal and distal ends;

means for limiting movement of the distal and proximal ends of both exercise arm assemblies within an upper body exercise plane;

means for limiting movement of the distal end, proximal end and pivot within an arm assembly plane, each arm assembly having its own limiting means; and means for applying an exercise resistance to the movement of each arm assembly distal end across the upper body exercise plane.

5. The apparatus recited in claim 4, further comprising means for changing the angular relationship between the upper body exercise plane and the arm assembly plane.

6. The apparatus recited in claim 4, further comprising:

a pair of exercise leg assemblies, each leg assembly supported along one side of the back rest and having a proximal end adjacent the back rest and a distal end, the leg assembly further having first and second segments with one of the first segments including the proximal end and one end of the second segment including the distal end, the first and second segments coupled together at a pivot intermediate between the leg assembly proximal and distal ends;

means for limiting movement of the leg assemblies distal and proximal ends within a lower body exercise plane;

means for limiting movement of the distal, proximal and pivot within a leg assembly plane, each leg assembly having its own limiting means; and means for applying an exercise resistance to the movement of each leg assembly distal end across the lower body exercise plane.

7. The apparatus recited in claim 6, further comprising means for changing the angular relationship between the lower body exercise plane and the leg assembly plane.

8. The apparatus recited in claim 6 wherein each limiting means comprises means for positively linking the first and second segments of each corresponding arm and leg assembly together to force simultaneous movement of the corresponding pivot as the respective assembly distal ends are moved through the exercise planes.

9. The apparatus recited in claim 8 wherein the positive linking means comprises:

a first sprocket rotatably supported by the first arm or leg segment;

a second sprocket fixed to the second arm or leg segment at the corresponding pivot; and a positive linkage belt engaging each first and second sprocket for rotation together.

10. The apparatus recited in claim 9 wherein each first sprocket has a substantially greater diameter than the corresponding second sprocket.

11. The apparatus recited in claim 4 wherein the exercise frame includes a seat extending generally lateral to and intersecting the back rest.

12. The apparatus recited in claim 4 wherein the exercise resistance means includes an elastic tension means coupled at one end to the first segment at a point intermediate between the proximal end and the pivot, and a second end to the second segment at a point intermediate between the distal end and the pivot; and wherein the elastic tension is a resistance to a movement of the distal end.

13. An exercise apparatus comprising:

an exercise frame;

an exercise assembly having:

a proximal end coupled to the frame and a distal end;

a first pivot member rotatably connecting the exercise assembly proximal end to the frame, the first pivot member having an axis of rotation perpendicular to a frame side portion, the first pivot member permitting the exercise assembly to be radially offset from the frame side portion along the first pivot member axis;

a second pivot member rotatably connecting the exercise assembly proximal end to the first pivot member for rotation about a second pivot member axis perpendicular to the first pivot member axis, the second pivot member permitting the exercise assembly to be offset from the first pivot member axis;

a first arm segment having a proximal end forming a part of the exercise assembly proximal end and a distal end forming a part of the exercise assembly distal end; and a third pivot member rotatably connecting the first arm segment proximal end to the exercise assembly proximal end, the third pivot member having an axis of rotation perpendicular to the second pivot member axis, the third pivot member permitting rotation of the first arm segment about the third pivot member and within an exercise assembly plane of rotation defined by a combination of an angular position of the exercise assembly proximal end rotated about the first and second pivot members;

means for limiting movement of the assembly first arm segment within the exercise assembly plane; and means for applying an exercise resistance to movement of the exercise assembly distal end about the proximal end, the movement within the exercise plane.

14. The apparatus recited in claim 13, further comprising:

a second arm segment having proximal and distal ends; and a fourth pivot member rotatably connecting the second arm segment proximal end to the first arm segment distal end, the fourth pivot member having an axis of rotation parallel to the third pivot member axis of rotation, the second arm segment thus rotatable about the fourth pivot axis within the exercise assembly plane.

15. The apparatus recited in claim 14, further comprising:

a grip assembly; and a fifth pivot member within the second arm segment distal end, the fifth pivot member having an axis of rotation parallel to the third and fourth axes of rotation, the fifth pivot member rotatably connecting the grip assembly to the second arm segment distal end for rotation of the grip assembly about the fifth pivot member and within the exercise assembly plane.

16. The apparatus according to claim 14, wherein the exercise resistance means applies a resistance to rotational movement of the second arm segment about the fourth pivot member.

17. The apparatus recited in claim 13, wherein the exercise resistance means applies a resistance to rotational movement of the first arm segment about the third pivot member.

* * * * *